US008550579B2

(12) United States Patent
Tsuchiya

(10) Patent No.: US 8,550,579 B2
(45) Date of Patent: Oct. 8, 2013

(54) IMAGE FORMING DEVICE, PUMP CONTROL METHOD, AND RECORDING MEDIUM

(75) Inventor: Tomokazu Tsuchiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 378 days.

(21) Appl. No.: 12/959,463

(22) Filed: Dec. 3, 2010

(65) Prior Publication Data

US 2011/0148955 A1 Jun. 23, 2011

(30) Foreign Application Priority Data

Dec. 17, 2009 (JP) ..... 2009-286787

(51) Int. Cl.
*B41J 2/01* (2006.01)
*B41J 2/17* (2006.01)

(52) U.S. Cl.
USPC ..... 347/1; 347/84

(58) Field of Classification Search
USPC ..... 347/1, 6, 7, 84
See application file for complete search history.

(56) References Cited

U.S. PATENT DOCUMENTS

| | | | | |
|---|---|---|---|---|
| 6,599,106 | B2 | 7/2003 | Harada et al. | |
| 7,789,475 | B2 | 9/2010 | Morishita et al. | |
| 2007/0296744 | A1* | 12/2007 | Kubota et al. | 347/7 |
| 2009/0231367 | A1 | 9/2009 | Tsuchiya | |
| 2010/0194795 | A1 | 8/2010 | Tsuchiya et al. | |
| 2010/0253717 | A1 | 10/2010 | Suzuki | |
| 2010/0328371 | A1* | 12/2010 | Livshitz et al. | 347/6 |

FOREIGN PATENT DOCUMENTS

| | | |
|---|---|---|
| JP | 2862359 | 3/1999 |
| JP | 3573059 | 10/2004 |
| JP | 4258693 | 4/2009 |
| JP | 2010-240870 | 10/2010 |

* cited by examiner

*Primary Examiner* — Stephen Meier
*Assistant Examiner* — Carlos A Martinez
(74) *Attorney, Agent, or Firm* — IPUSA, PLLC

(57) ABSTRACT

An image forming device includes a pump which supplies a recording fluid contained in a first container to a second container via a tube, and a control unit configured to perform rotation of a roller disposed in the pump to press the tube and feed the recording fluid in the tube. When a negative pressure in the second container is not formed by performing a first backward rotation of the roller by a predetermined amount, the control unit performs a forward rotation of the roller and performs a second backward rotation of the roller after an end of the forward rotation.

13 Claims, 16 Drawing Sheets

FIG.13

520

| TEMPERATURE | HUMIDITY | AMOUNT OF BACKWARD OPERATION |
|---|---|---|
| BELOW 0 DEG. C | BELOW 30% | 5.5 SECONDS |
| | BETWEEN 30% AND 70% | 5.0 SECONDS |
| | ABOVE 70% | 4.5 SECONDS |
| BETWEEN 0 DEG. C AND 50 DEG. C | BELOW 30% | 4.2 SECONDS |
| | BETWEEN 30% AND 70% | 4.0 SECONDS |
| | ABOVE 70% | 3.8 SECONDS |
| ABOVE 50 DEG. C | BELOW 30% | 3.8 SECONDS |
| | BETWEEN 30% AND 70% | 3.7 SECONDS |
| | ABOVE 70% | 3.6 SECONDS |

IMAGE FORMING DEVICE, PUMP CONTROL METHOD, AND RECORDING MEDIUM

BACKGROUND OF THE INVENTION

1. Field of the Invention

The present disclosure relates to an image forming device, a pump control method, and a recording medium which are adapted to form an image using a recording fluid.

2. Description of the Related Art

Conventionally, image forming devices of recording-fluid discharge type are known and these image forming devices perform image formation using a recording head having a nozzle for discharging a recording fluid drop (for example, ink drop). When performing image formation, the recording head discharges an ink drop from the nozzle to a recording sheet while the recording sheet is transported.

Among the image forming devices of the above type, an image forming device including a tube pump which is provided as an ink supplying pump for supplying ink from an ink cartridge to a recording head is known. For example, refer to Japanese Patent No. 3573059. In this image forming device, operation of the tube pump is started to supply ink from an ink cartridge (main tank) through a tube to a head tank (subtank) of the recording head.

When the operation of the tube pump is stopped, the tube in the tube pump is in a compressed condition. As a result, the supplying of ink through the tube is interrupted, which prevents the natural outflow of the ink from the main tank or the fluctuation of the pressure of the head tank from occurring due to negative pressure in the head tank.

However, if the tube continuously stays in the compressed condition when the supplying of ink through the tube is interrupted, the internal wall of the compressed tube may stick to a tube supporting wall of the tube pump. In such a case, even if the operation of the tube pump is reversed at a subsequent time, negative pressure in the head tank may not be formed due to the sticking of the tube, and as a result the tube pump is not operable to suck ink from the main tank.

SUMMARY OF THE INVENTION

In one aspect, the present disclosure provides an image forming device, a pump control method, and a recording medium which are capable of appropriately preventing sticking of a tube in a tube pump which supplies a recording fluid to a recording head.

In an embodiment which solves or reduces one or more of the above-mentioned problems, the present disclosure provides an image forming device including: a pump which supplies a recording fluid, contained in a first container, to a second container via a tube; and a control unit configured to perform rotation of a roller, disposed in the pump, to press the tube and feed the recording fluid in the tube, wherein, when a negative pressure in the second container is not formed by performing a first backward rotation of the roller by a predetermined amount, the control unit performs a forward rotation of the roller and performs a second backward rotation of the roller after an end of the forward rotation.

Other objects, features and advantages of the present disclosure will become more apparent from the following detailed description when read in conjunction with the accompanying drawings.

BRIEF DESCRIPTION OF THE DRAWINGS

FIG. 13 is a diagram illustrating an example of a table of backward-operation amounts.

DETAILED DESCRIPTION OF THE PREFERRED EMBODIMENTS

A description will be given of embodiments of the present disclosure with reference to the accompanying drawings.

Figure 1:
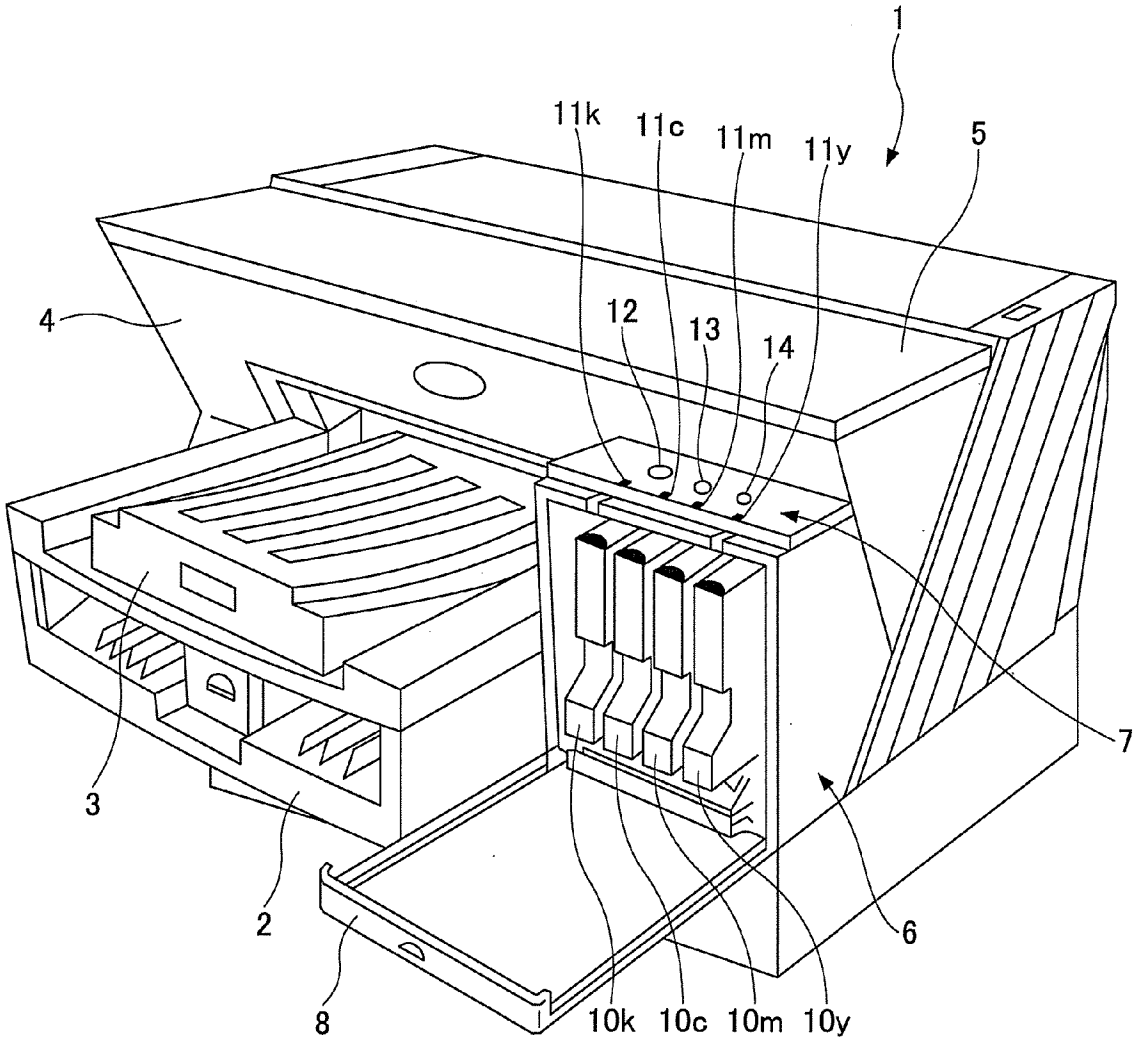
FIG. 1 is a perspective view illustrating the outline composition of an image forming device of an embodiment of the present disclosure.

FIG. 1 is a perspective view illustrating the outline composition of an image forming device of an embodiment of the present disclosure. As illustrated in FIG. 1, the image forming device 1 of this embodiment includes a sheet feed tray 2, a sheet output tray 3, a cartridge mounting part 6, an operation panel 7, a cartridge cover 8, and an ink cartridge 10.

The sheet feed tray 2 is a tray in which a number of recording sheets are loaded. The sheet output tray 3 is a tray on which a recording sheet, which is fed from the sheet feed tray 2, carries an image formed thereon, and is ejected from the image forming device 1 is stacked. The sheet output tray 3 is detachably attached to the image forming device 1.

The cartridge mounting part 6 is a portion of the image forming device 1 to which the ink cartridge 10 is detachably attached. The ink cartridge 10 attached to the cartridge mounting part 6 may be exchanged with a new one. In the example illustrated in FIG. 1, the cartridge mounting part 6 is arranged at a right-hand end part of a front surface 4 of the image forming device 1 and under an upper surface 5 of the image forming device 1 such that the cartridge mounting part 6 projects to the front side.

The ink cartridge 10 includes a tank in which a recording fluid (ink) is contained. In the example illustrated in FIG. 1, four ink cartridges 10*k*, 10*c*, 10*m*, and 10*y* which respectively contain inks of different colors, including black (K), cyan (C), magenta (M), and yellow (Y) are provided. These ink cartridges will be collectively called "ink cartridge 10" when an individual ink color is not distinguished.

The cartridge cover 8 is a cover which is secured to the cartridge mounting part 6 such that the cartridge cover 8 is free to open and close. The cartridge cover 8 in the closed state protects the ink cartridge 10 from the outside. The cartridge cover 8 is opened when the ink cartridge 10 is detached from or attached to the cartridge mounting part 6.

The operation panel 7 includes a set of operation buttons, a set of indicators, etc. For example, the operation panel 7 includes residual amount indicator areas 11*k*, 11*c*, 11*m*, and 11*y* corresponding to the arranging positions (or mounting positions) of the ink cartridges 10*k*, 10*c*, 10*m*, and 10*y*. These residual amount indicator areas will be collectively called residual amount indicator area 11 when an individual ink color is not distinguished. Each residual amount indicator area 11 is constituted by an indicator which notifies a user that the residual amount of ink in the corresponding ink cartridge 10 reaches a near end or an end. In addition, a power button 12, a sheet-feed/print-restart button 13, and a cancel button 14 are arranged on the operation panel 7.

Figure 2:
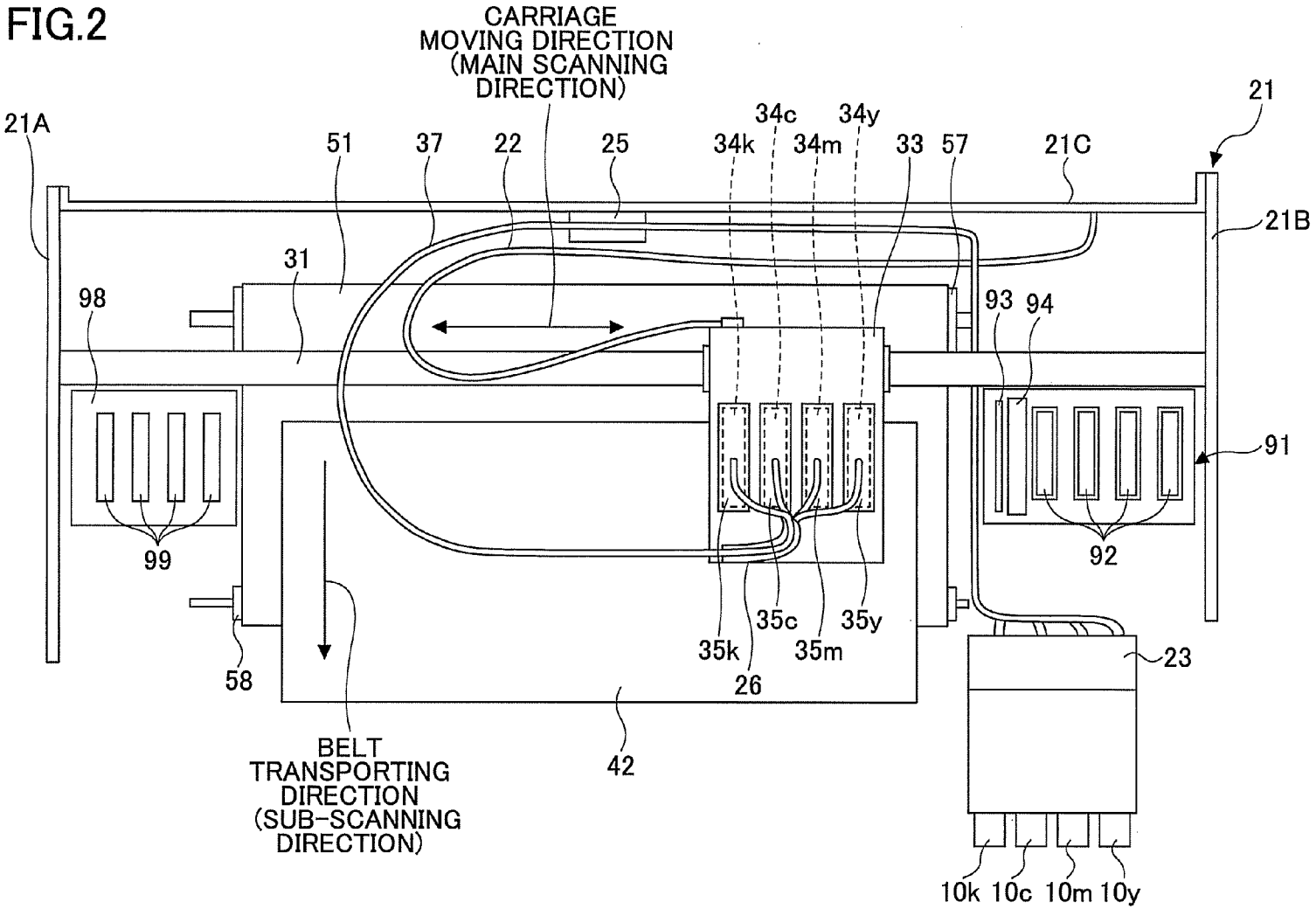
FIG. 2 is a plan view illustrating the composition of a mechanical part of the image forming device of the present embodiment.
Figure 3:
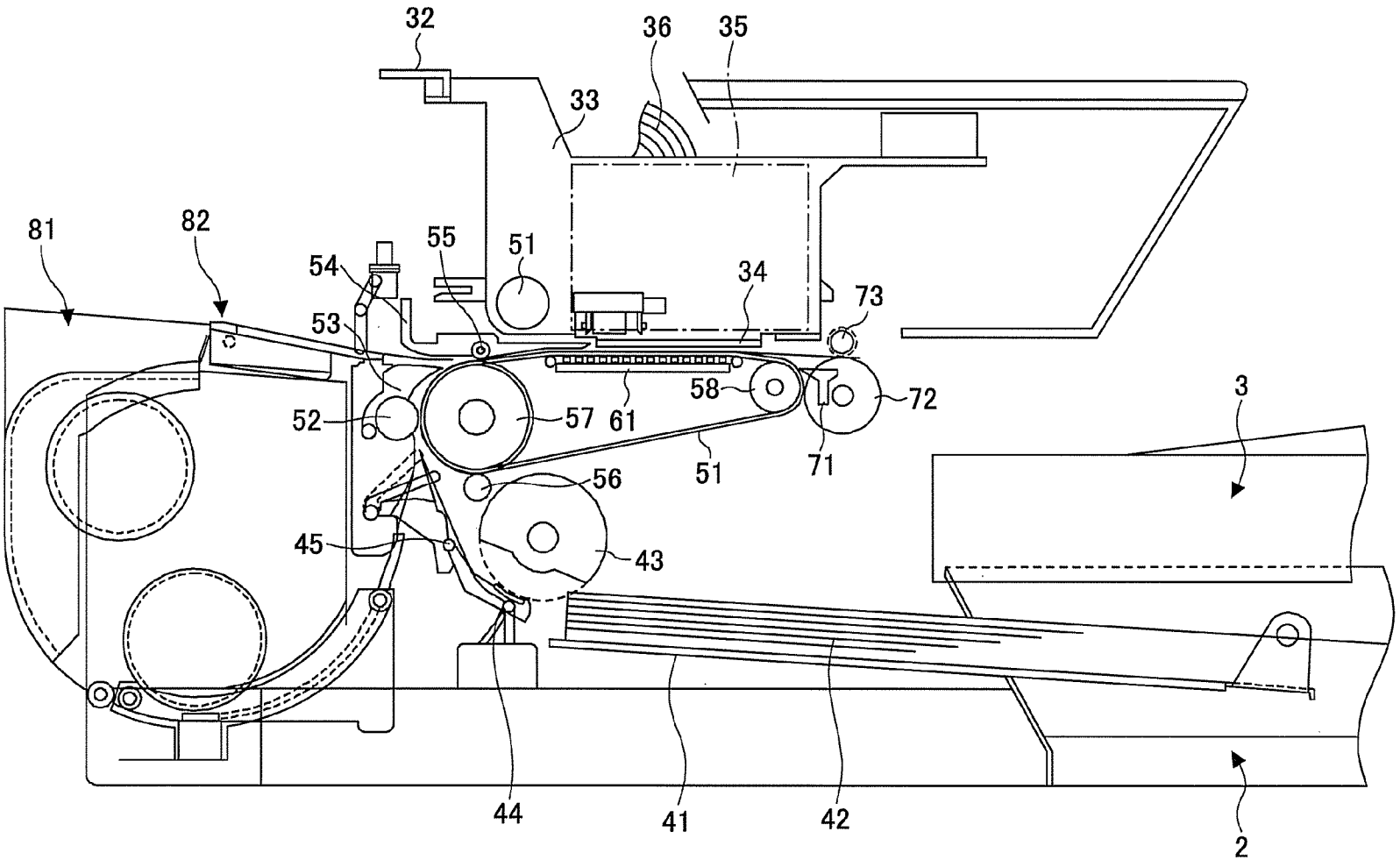
FIG. 3 is a side view illustrating the composition of the mechanical part of the image forming device of the present embodiment.

Next, the composition of a mechanical part of the image forming device 1 of this embodiment will be described. FIG. 2 is a plan view illustrating the composition of a mechanical part of the image forming device of this embodiment. FIG. 3 is a side view illustrating the composition of the mechanical part of the image forming device 1 of this embodiment.

As illustrated in FIG. 2, a frame 21 forms the outline of the body part of the image forming device 1. The frame 21 includes side plates 21A and 21B which form the side surfaces of the body part of the image forming device 1 respectively. A guide rod 31 is horizontally disposed between the side plates 21A and 21B, and this guide rod 31 is a guide member of the carriage 33. As illustrated in FIG. 3, a stay 32 is disposed at a front-end upper part of the carriage 33, and the carriage 33 is held by the stay 32 and the guide rod 31 such that the carriage 33 is slidable in a main scanning direction. The carriage 33 is moved by a main-scan motor (not illustrated) so that the carriage 33 slides in a direction parallel to the direction indicated by the arrow in FIG. 2 (which direction will be called carriage moving direction or main scanning direction).

A plurality of recording heads 34 are disposed on the carriage 33. Each recording head 34 is a recording fluid drop discharging head which is constituted by an ink jet head for discharging an ink drop. Each recording head 34 includes a plurality of nozzles which are arrayed in the direction perpendicular to the main scanning direction such that the ink discharge outlets thereof are directed to the vertical downward direction. The recording head 34 as illustrated in FIG. 2 is constituted by four recording heads 34*k*, 34*c*, 34*m*, and 34*y*. These recording heads 34*k*, 34*c*, 34*m*, and 34*y* discharge ink drops of black (K), cyan (C), magenta (M), and yellow (Y), respectively. These recording heads 34*k*, 34*c*, 34*m*, and 34*y* will be collectively called "recording head 34" when the color of each ink is not distinguished. As the pressure generating elements for generating pressure for discharging ink drops, provided in the recording fluid drop discharging head which constitutes the recording head 34, any of piezoelectric actuators using piezoelectric elements, electrostatic actuators using electrostatic force, thermal actuators using electro-thermal conversion elements, shape memory alloy actuators, etc. may be used.

Furthermore, a plurality of head tanks 35*k*, 35*c*, 35*m*, and 35*y* are disposed on the carriage 33 and these head tanks are provided for supplying the inks of different colors to the plurality of recording heads 34 respectively. These head tanks 35*k*, 35*c*, 35*m*, and 35*y* will be collectively called "head tank 35" when the color of each ink is not distinguished. One of the inks of the four colors from one of the ink cartridges 10 is supplied to one of the head tanks 35 via one of a plurality of ink-supply tubes 37. These ink-supply tubes 37 will also be collectively called "ink-supply tube 37" when the color of each ink is not distinguished.

As illustrated in FIG. 1, the ink cartridge 10 is detachably attached to the cartridge mounting part 6. As illustrated in FIG. 2, an ink-supply pump unit 23 for supplying the ink in the ink cartridge 10, is attached to the cartridge mounting part 6. The ink-supply tube 37 is fixed, at a position in the middle of the path from the ink cartridge mounting part 6 to the head tank 35, to a backboard 21C which forms a part of the frame 21, by a holder 25 disposed on the body part side. An end portion of the ink-supply tube 37 is fixed to the upper surface of the carriage 33 by a fixing rib 26.

As illustrated in FIG. 3, a feed roller 43 and a separating pad 44 are arranged as a sheet feeding part for feeding the recording sheets 42 loaded on the bottom plate 41 of the sheet feed tray 2. The feed roller 43 is formed to have a generally semicircular cross-section. The feed roller 43 and the separating pad 44 function to sequentially separate a recording sheet 42 from the recording sheets 42 on the bottom plate 41 and feed the recording sheet 42. The separating pad 44 confronts the feed roller 43 and is pushed against the feed roller 43 side. The separating pad 44 is formed of a material with a large friction coefficient.

In the image forming device 1, there is provided a sheet transporting part for transporting the recording sheet 42 fed from the sheet feeding part to a position under the recording head 34. This sheet transporting part includes a transporting belt 51, a counter roller 52, a transporting guide 53, a retainer member 54, and a front-end pressing roller 55 arranged therein.

The transporting belt 51 is constituted by an endless belt. The transporting belt 51 is wound between a transporting roller 57 and a tension roller 58 so that the transporting belt 51 is circulated in a belt transporting direction (sub-scanning direction). For example, the transporting belt 51 is formed to have an upper layer (which serves as a recording-sheet attracting surface) formed of a pure resin material (for example, ETFE) with a thickness of about 40 micrometers which is not subjected to resistance control, and lower layers (a middle resistive layer, a ground layer) which is formed of the same resin material as that of the upper layer and subjected to resistance control with carbon. When the transporting belt 51 is circulated, the transporting belt 51 transports the recording sheet 42 while attracting the recording sheet 12 by electrostatic force. The surface of the transporting belt 51 is electrostatically charged by a charging roller 56. The charging roller 56 is arranged to contact the upper layer of the transporting belt 51, and the charging roller 56 is rotated to follow the circulating movement of the transporting belt 51. A predetermined pressing force is exerted on the ends of the shaft of the charging roller 56.

The counter roller 52 is arranged such that the recording sheet 42, fed from the sheet feeding part via the guide 45, is pinched between the counter roller 52 and the transporting belt 51 and the recording sheet 42 is transported. The transporting guide 53 is arranged to turn the vertical upward direction of the recording sheet 42 fed from the guide 45, by about 90 degrees and bring the recording sheet 42 toward the transporting belt 51. The front-end pressing roller 55 is arranged such that the front end of the recording sheet 42 sent from the transporting guide 53 is pinched between the roller 55 and the transporting belt 51 and transported. The retainer member 54 is arranged to push the front-end pressing roller 55 against the transporting belt 51.

A guide member 61 is disposed on the inner circumference of the transporting belt 51 in a region corresponding to the printing region for the recording head 34. The upper surface of the guide member 61 projects toward the recording head 34 to exceed the common tangent line between the two rollers (the transporting roller 57 and the tension roller 58) arranged to support the transporting belt 51. Thereby, the transporting belt 51 in the printing region is lifted and guided by the upper surface of guide member 61. As a result, the flatness of the transporting belt 51 in the printing region is maintained at an adequately high level.

In the image forming device 1, there is provided a sheet ejecting part for ejecting the recording sheet 42 with an image formed thereon by the recording head 34 to the sheet output tray 3. This sheet ejecting part includes a separating claw 71, a sheet ejection roller 72, a sheet ejection roller 73, and the sheet output tray 3.

The separating claw 71 is arranged to separate the recording sheet 42 from the transporting belt 51. The height dimension of the interposing part between the sheet ejection roller 72 and the sheet ejection roller 73 from the sheet output tray 3 is set to be adequately large, in order to increase the number of recording sheets which can be stacked on the sheet output tray 3.

A duplex unit 81 is detachably attached to the back-side portion of the image forming device 1. The duplex unit 81 is arranged to receive the recording sheet 42 returned from the recording head 34 by backward rotation of the transporting belt 51, reverse the recording sheet 42 and transport it again to the interposing part between the front-end pressing roller 55 and the transporting belt 51. A manual feeding part 82 is disposed on the upper surface of the duplex unit 81.

As illustrated in FIG. 2, a maintenance recovery device 91 is disposed in a non-printing region on the side of one end of the carriage 33 in the main scanning direction (or the right-hand end portion in FIG. 2), and the maintenance recovery device 91 includes the recovery unit for maintaining and recovering the state of the nozzles of the recording head 34. The maintenance recovery device 91 includes a set of cap members (which will be referred to as caps) 92, a wiper blade 93, and a warm-up discharge receptacle 94.

The caps 92 are arranged for capping the respective faces of the nozzles of the recording head 34. For example, one of the caps 92 is used as a suction/moisturizing cap and another of the caps 92 is used as a moisturizing cap. The wiper blade 93 is a blade member for wiping the respective faces of the nozzles of the recording head 34. The warm-up discharge receptacle 94 is arranged to store a certain amount of ink which is, discharged when a warm-up discharge operation is performed in order to remove the non-used or waste ink with an increased viscosity.

A warm-up discharge receptacle 98 is disposed in a non-printing region on the side of the other end of the carriage 34 in the main scanning direction (or the left-hand end portion in FIG. 2). The warm-up discharge receptacle 98 is arranged to store a certain amount of ink which is discharged when a warm-up discharge operation is performed. In the warm-up discharge receptacle 98, openings 99 are formed and arranged along the direction of the nozzle rows of the recording heads 34.

In the image forming device 1 as described above, a recording sheet 42 is fed from the sheet feed tray 2. The recording sheet 42 fed in the vertical upward direction is guided by the guide 45, and the recording sheet 42 is pinched between the transporting belt 51 and the counter roller 52 and is transported. The recording sheet 42 is guided by the transporting guide 53, and the front end of the recording sheet 42 is pushed against the transporting belt 51 by the front-end pressing roller 55. Hence, the sheet transporting direction is changed about 90 degrees. At this time, an alternating voltage which is alternately changed between a positive voltage and a negative voltage is generated from a high-voltage power source and supplied to the charging roller 56 by a control circuit (not illustrated). As a result, the positively charged rectangular regions and the negatively charged rectangular regions each having a predetermined width are alternately arrayed in the transporting belt 51 in the sub-scanning direction which is parallel to the belt transporting direction. When the recording sheet 42 is transported to the transporting belt 51 in which the positively charged rectangular regions and the negatively charged rectangular regions are alternately arrayed, the recording sheet 42 is electrostatically attracted by the transporting belt 51. The recording sheet 42 is transported in the sub-scanning direction by the circulating movement of the transporting belt 51.

Subsequently, image formation is performed by the recording head 34 to form an image on the recording sheet 42. Specifically, the carriage 33 is moved in the main scanning direction while the recording head 34 on the carriage 33 is driven in accordance with an image signal. The recording head 34 discharges ink drops to form an image on the recording sheet 42 in the stopped state, and one line of the image is formed on the recording sheet 42. The recording sheet 42 is transported in the sub-scanning direction by a given amount, and image formation of a following line of the image is performed in the same manner. When a print end signal or a detection signal indicating that the trailing end of the recording sheet 42 reaches the image formation area is detected, the image forming operation is terminated. The recording sheet 42 is delivered to the sheet output tray 3.

During a standby state of the recording head 34, the carriage 33 is moved to the location where the maintenance recovery device 91 is disposed. Then, the nozzles of the recording head 34 of the carriage 33 are capped with the caps 92. As a result, the nozzles of the recording head 34 are maintained in a wet condition, thereby preventing poor discharging of ink due to dryness of the nozzles. As a recovery operation for removing the non-used or waste ink with an increased viscosity or bubbles from the nozzles of the recording head 34, ink is sucked from the nozzles of the recording head 34 in the state in which the nozzles are capped with the caps 92. In the following, this recovery operation will be called "nozzle suction" operation (or "head suction" operation). In addition, a warm-up discharging operation is performed before a start of image formation or in the middle of image formation, to discharge from the nozzles of the recording head 34 a certain amount of ink which is not related to image formation. Accordingly, by using the maintenance recovery device 91, the discharging performance of the recording head 34 is reliably maintained in an appropriate condition.

Figure 4:
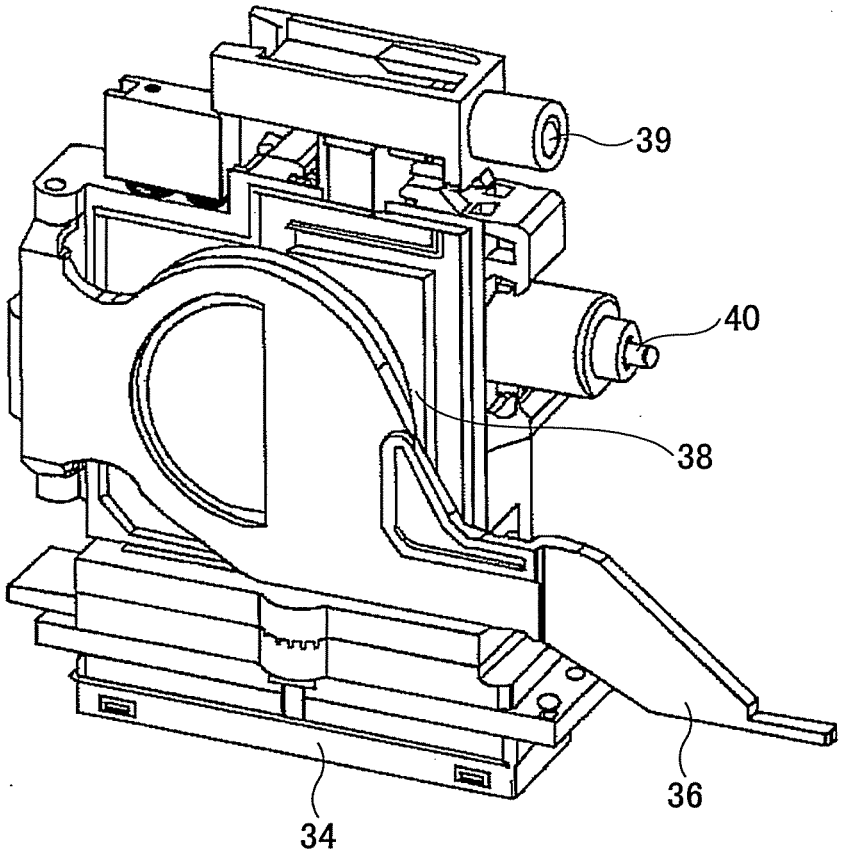
FIG. 4 is a perspective view illustrating the composition of a head tank.

Next, the structure of the head tank 35 will be described. FIG. 4 is a perspective view illustrating the composition of a head tank. The ink cartridge 10 constitutes a main tank (first container) which contains ink, and the head tank 35 constitutes a subtank (second container) which contains ink. As illustrated in FIG. 4, the head tank 35 includes a filler 36, a film 38, a supply port 39, and an air opening pin 40.

The filler 36 is disposed on the side surface of the head tank 35 and attached to the film 38. A compressive pressure is exerted on the filler 36 against the film 38 such that the filler 36 moves to follow the deformation of the film 38. The film 38 is deformed by a spring (not illustrated) according to the consumption of ink in the head tank 35 in which negative pressure is formed. The supply port 39 is an inlet port to which ink is supplied from the ink cartridge 10 through the tube 37. The air opening pin 40 is a pin for opening the inside of the head tank 35 to the atmosphere when needed. The recording head 34 is disposed under the head tank 35.

Figure 5:
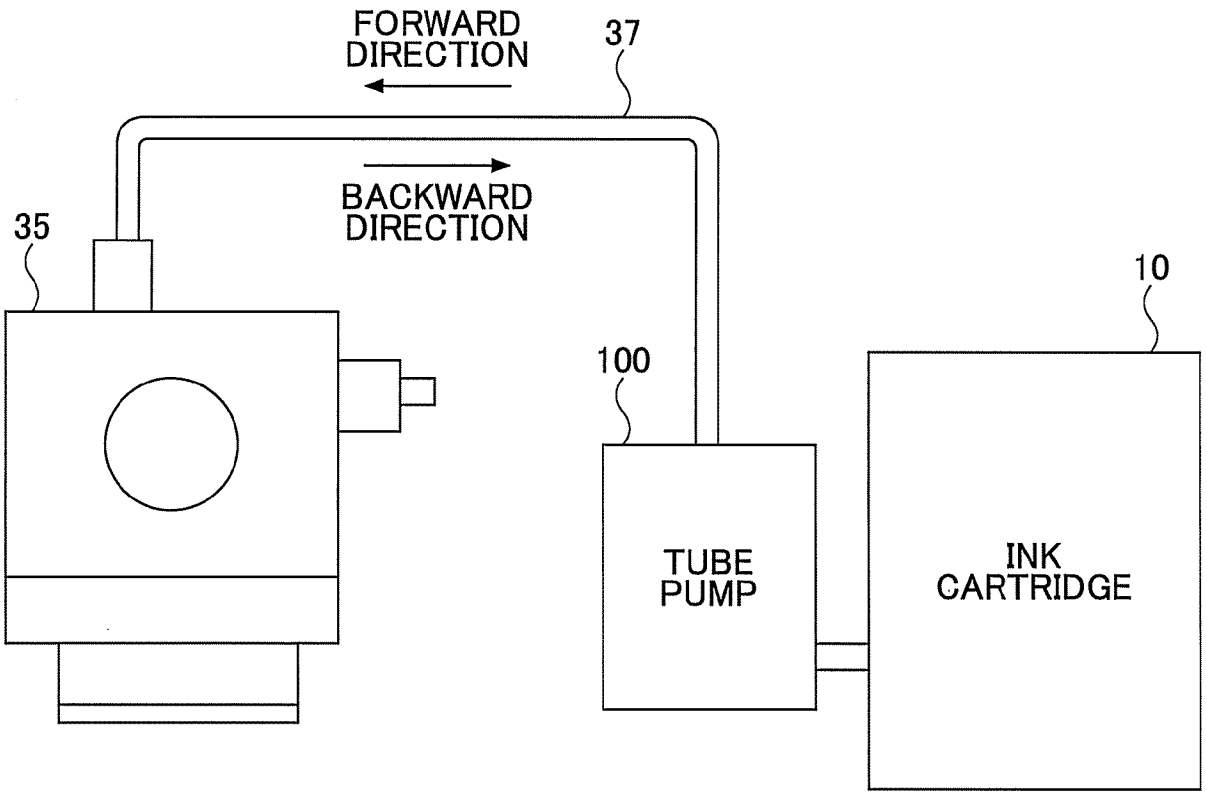
FIG. 5 is a diagram for explaining an ink supplying device for supplying ink to a head tank.

Next, an ink supplying device for supplying ink to the head tank 35 will be described. FIG. 5 is a diagram for explaining an ink supplying device for supplying ink to the head tank.

The ink supplying device in FIG. 5 is equivalent to one of the ink supplying devices of the four colors contained in the ink-supply pump unit 23 in FIG. 2. Namely, the ink cartridge 10, the tube pump 100, the ink-supply tube 37, and the head tank 35, as illustrated in FIG. 5, constitute the ink supplying device of one color. The ink-supply pump unit 23 in FIG. 2 is constructed to contain the four ink supplying devices of the four colors (KCYM) each of which is the same as that illustrated in FIG. 5.

If the ink in the head tank 35 is consumed by a printing or maintenance operation, ink from the ink cartridge 10 is supplied through the tube 37 to the head tank 35 by the tube pump 100. Hence, the head tank 35 is supplemented with ink. If no operation is performed at this time, the inside of the head tank 35 is subjected to positive pressure with the ink supplied thereto, which will cause the ink to leak from the nozzles of the recording head 34.

To avoid this problem, the image forming device 1 of this embodiment is arranged so that a certain amount of ink contained in the head tank 35 is returned back to the ink cartridge 10 by using the tube pump 100 (backward operation of the tube pump 100). As a result, negative pressure in the head tank 35 is formed by the backward operation of the tube pump 100, and the leaking of ink from the nozzles of the recording head 34 is prevented. The ink supplying device of this embodiment enables the reduction of the amount of ink consumption to an amount that is smaller than that of a case in which ink is additionally discharged from the nozzles of the recording head 34 to form negative pressure in the head tank 35 in the same situation.

Figure 6:
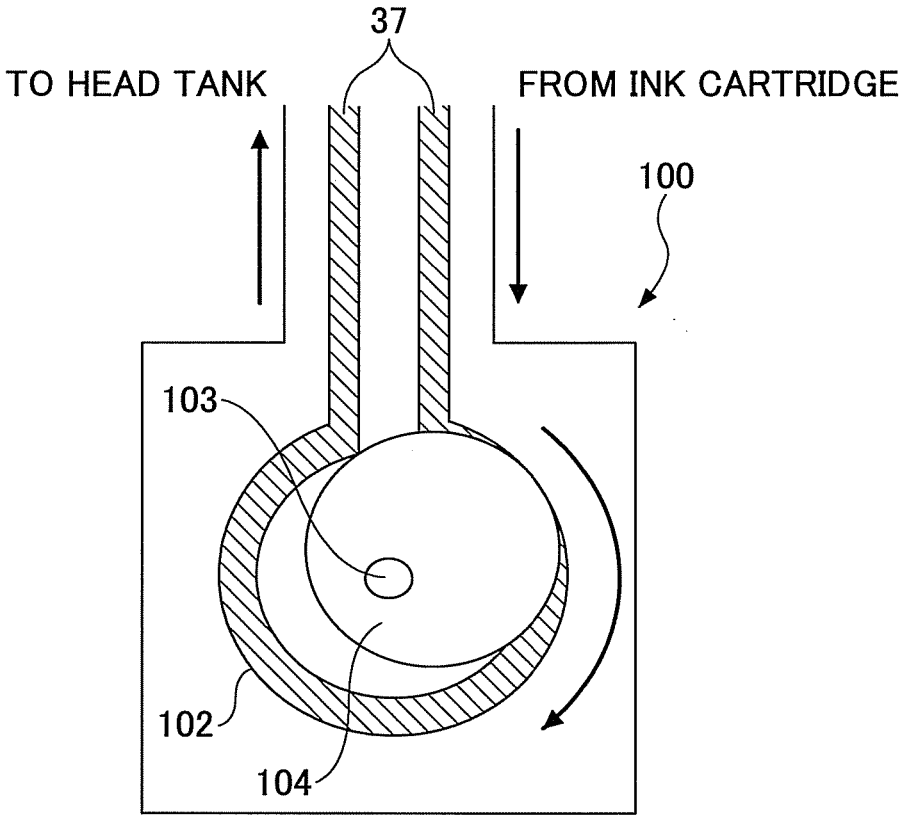
FIG. 6 is a diagram for explaining an internal structure of a tube pump.

Next, an internal structure of the tube pump 100 will be described. FIG. 6 is a diagram for explaining the internal structure of the tube pump. Inside the tube pump 100, a flexible ink-supply tube 37 is arranged so that the flexible ink-supply tube 37 is supported on a tube supporting wall 102 of the tube pump 100. Namely, the tube 37 is supported along the tube supporting wall 102. An off-center cam type pressing roller 104 is rotated around a shaft 103, and the roller 104 presses the ink-supply tube 37 against the tube supporting wall 102 so that the tube 37 is locally crushed against the tube supporting wall 102. As a result, ink is fed in the direction of rotation of the pressing roller 104. In FIG. 6, ink is illustrated by the hatching.

Accordingly, if the direction of rotation of a drive motor for rotating the pressing roller 104 is switched, the tube pump 100 is able to selectively supply ink in one of the forward direction and the backward direction. In the forward operation of the tube pump 100 (by the forward rotation of the drive motor), the ink from the ink cartridge 10 is supplied through the tube 37 to the head tank 35. In the backward operation of the tube pump 100 (by the backward rotation of the drive motor), the ink from the head tank 35 is supplied through the tube 37 to the ink cartridge 10. Specifically, the two upper arrows in FIG. 6 indicate the forward direction of supplying the ink through the tube 37 during the forward operation of the tube pump 100, and the lower arrow in FIG. 6 indicates the forward direction of rotation of the pressing roller 104 around the shaft 103 during the forward operation of the tube pump 100. A DC motor may be used as an example of the drive motor for rotating the pressing roller 104.

Figure 7:
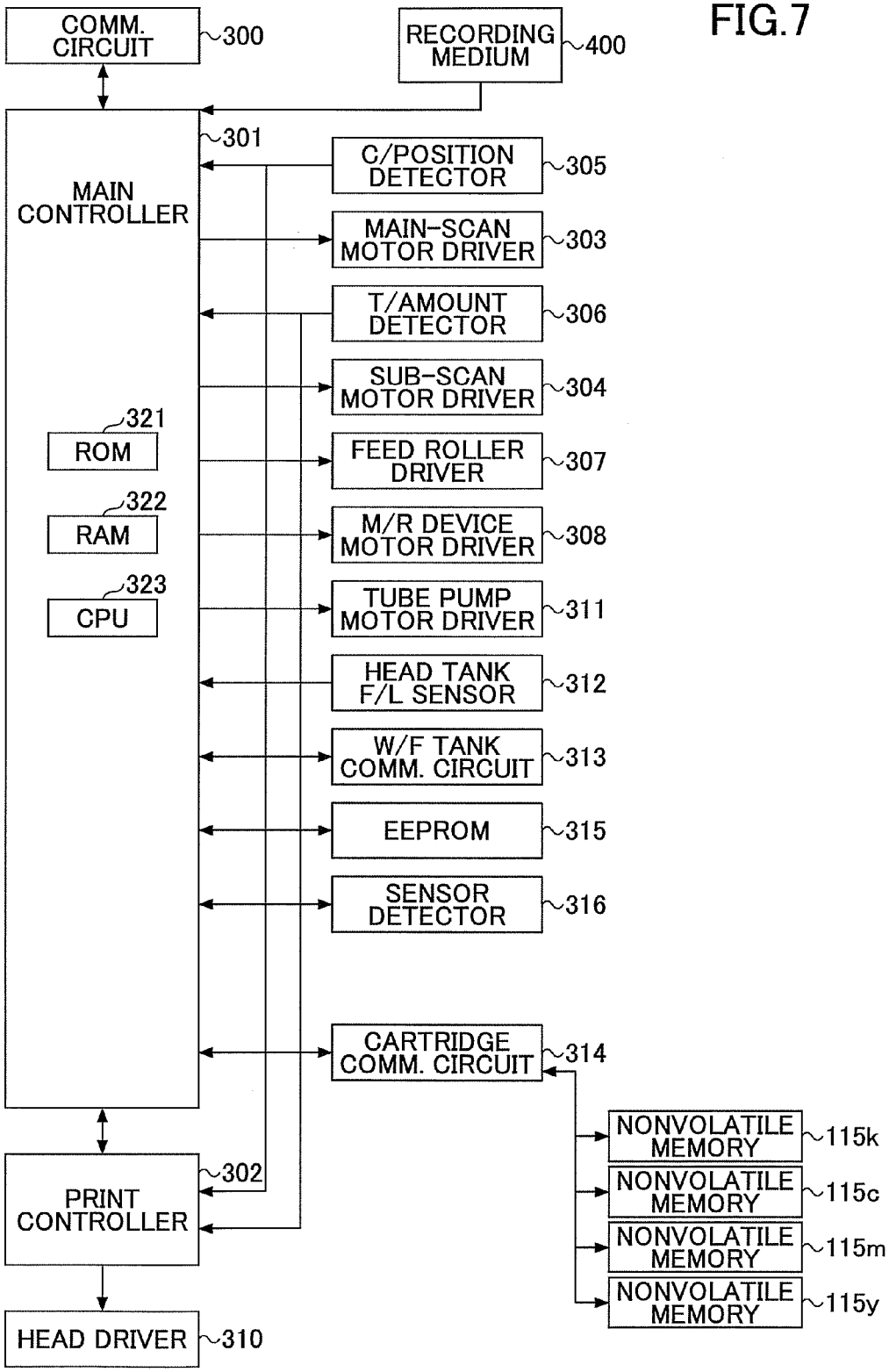
FIG. 7 is a block diagram illustrating the composition of a main controller of the image forming device of the present embodiment.

Next, the composition of a main controller which controls operation of the image forming device 1 will be described. FIG. 7 is a block diagram illustrating the composition of a main controller 301 of the image forming device 1 of this embodiment.

In FIG. 7, the main controller 301 is constituted by a microcomputer and includes a ROM 321, a RAM 322, and a CPU 323. A program for controlling operation of the image forming device 1 is stored in the ROM 321. The RAM 322 is used to provide a storage area where the program is loaded, and a working storage area of the loaded program. The CPU 323 controls operation of the image forming device 1 in accordance with instruction codes of the program loaded to the RAM 322. For example, the CPU 323 performs interruption or restart of a maintenance/recovery operation, a control operation of the tube pump 100, etc. Alternatively, the program for controlling operation of the image forming device 1 may be stored in a portable recording medium 400, such as a USB (universal serial bus) memory, a CD-ROM, or an SD card. In this case, the program stored in the recording medium 400 is loaded to the RAM 322, and the CPU 323 is caused to perform a control process in order to control operation of the image forming device 1.

As illustrated in FIG. 7, various elements are connected to the main controller 301, which include a communication circuit 300, a print controller 302, a main-scan motor driver circuit 303, a sub-scan motor driver circuit 304, a carriage position detector circuit 305, a transport-amount detector circuit 306, a feed roller driver circuit 307, a maintenance/recovery device motor driver circuit 308, a tube pump motor driver circuit 311, a head tank full-level sensor 312, a waste-fluid tank communication circuit 313, a cartridge communication circuit 314, an EEPROM 315, and a sensor detecting circuit 316.

The communication circuit 300 receives print data (for example, a PDL (page description language) data) from an external device (not illustrated) via a network and inputs the received print data to the main controller 301. The print data is converted into printing data (for example, image data which is described according to the CMYK color space) by the main controller 301, and the printing data is transmitted to the print controller 302.

The main-scan motor driver circuit 303 and the sub-scan motor driver circuit 304 respectively drive the main-scan motor and the sub-scan motor in accordance with the control of image formation performed by the main controller 301 based on the printing data in order to form an image on a recording sheet 42. Specifically, the main-scan motor driver circuit 303 causes the main-scan motor to rotate according to the carriage moving amount specified by the main controller 301, so that the carriage 33 is moved to a predetermined position at a predetermined moving speed. The sub-scan motor driver circuit 304 causes the sub-scan motor to rotate according to the belt transporting amount specified by the main controller 301, so that the transporting roller 57 is rotated to move the transporting belt 51 to a predetermined position at a predetermined speed.

The carriage position detector circuit 305 detects a position of the carriage 33 and transmits to the main controller 301 a detection signal which indicates the detected position of the carriage 33. The main controller 301 controls the moving position and the moving speed of the carriage 33 based on the detection signal. For example, the carriage position detector circuit 305 is arranged to optically read out and calculate the number of slits of an encoder sheet disposed on the carriage 33 in the main scanning direction by using a photosensor disposed on the carriage 33, so that the carriage position detector circuit 305 detects the position of the carriage 33.

The transporting amount detector circuit 306 detects a belt moving amount of the transporting belt 51 and transmits to the main controller 301 a detection signal which indicates the detected belt moving amount of the transporting belt 51 as the transporting amount. The main controller 301 controls the belt moving amount and the moving speed of the transporting belt 51 based on the detection signal. For example, the transporting amount detector circuit 306 is arranged to detect the belt moving amount by optically reading and calculating the number of slits of a rotary encoder sheet disposed on the rotating shaft of the transporting roller 57 by using a photosensor.

The feed roller driver circuit 307 causes the feed roller 43 to rotate by one revolution in response to the feed roller driving command received from the main controller 301. The maintenance/recovery device motor driver circuit 308 causes the maintenance/recovery motor (not illustrated) to rotate in response to the command received from the main controller 301, so that the maintenance/recovery device motor driver circuit 308 performs the lifting and lowering of the cap 92 and the lifting and lowering of the wiper blade 93.

The tube pump motor driver circuit 311 causes the driving motor of the tube pump 100 to rotate in response to the command received from the main controller 301, so that the pressing roller 104 is rotated in the controlled rotating direction by the driving motor. The rotation of the pressing roller 104 in the controlled rotating direction by the tube pump motor driver circuit 311 enables the supplying of ink from the ink cartridge 10 to the head tank 35 to fill the head tank 35 with the ink, and enables the sucking of ink from the head tank 35 into the ink cartridge 10 to form negative pressure in the head tank 35.

The head tank full-level sensor 312 detects a full level of the ink contained in the head tank 35 and transmits to the main controller 301 a detection signal indicating the full level of the ink in the head tank 35. The main controller 301 controls the supplying of ink to the head tank (sub-tank) 35 based on the detection signal.

The cartridge communication circuit 314 is provided for the main controller 301 to receive the cartridge-related information stored in the nonvolatile memories 115*k*, 115*c*, 115*m*, and 115*y* provided in the respective ink cartridges 10. The main controller 301 performs a predetermined process with respect to the received information and stores the processed information after the predetermined process in the EEPROM 315.

The print controller 302 is constituted by a microcomputer. The print controller 302 generates head driving data for driving the pressure generating elements of the recording head 34 based on the printing data received from the main controller 301, the carriage position received from the carriage position detector circuit 305, and the transporting amount received from the transporting amount detector circuit 306. The head driving data for driving the pressure generating elements is used to cause the recording head 34 to discharge recording fluid drops from the nozzles of the recording head 34. The print controller 302 transmits the generated head driving data to the head driver circuit 310.

The head driver circuit 310 drives the pressure generating elements of the recording head 34 (which may be piezoelectric elements in a case of a piezoelectric type recording head) based on the head driving data received from the print controller 302, to discharge recording fluid drops from the nozzles of the recording head 34.

The waste-fluid tank communication circuit 313 is provided for the main controller 301 to receive the waste-fluid tank related information stored in the nonvolatile memory provided in the waste-fluid tank (not illustrated). The main controller 301 performs a predetermined process with respect to the received information and stores the processed information after the predetermined process in the EEPROM 315. The main controller 301 detects whether the waste-fluid tank is disposed in the image forming device 1 (or detects the presence of the waste-fluid tank) by detecting whether the information stored in the nonvolatile memory can be read by using the waste-fluid tank communication circuit 313.

The sensor detecting circuit 316 detects the state of the printer (the image forming device 1) and transmits to the main controller 301 a detection signal which indicates the detected printer state. For example, the sensor detecting circuit 316 may detect whether the cover of the body part of the image forming device 1 is in an open position. Alternatively, the sensor detecting circuit 316 may detect whether the recording sheet is transported in the process of recording sheet transport, in order to check whether the recording sheet 42 is left in the body part.

Next, a control process performed by the main controller 301 to carry out the process of negative pressure formation in the head tank 35 will be described.

Typically, the process of negative pressure formation is carried out in the process of performing an air-open ink filling procedure. In the following, the control process performed by the main controller 301 of this embodiment to carry out the air-open ink filling procedure will be described. The air-open ink filling procedure is to fill up the head tank 35 with ink while the air opening pin 40 of the head tank 35 is opened to remove the remaining air in the head tank 35. For example, the air-open ink filling procedure is performed for the purpose of recovering the state of the recording head 34 after an end of a printing operation having output a large number of printouts, or before a start of a printing operation after the image forming device 1 has not been used over an extended period of time.

Figure 8:
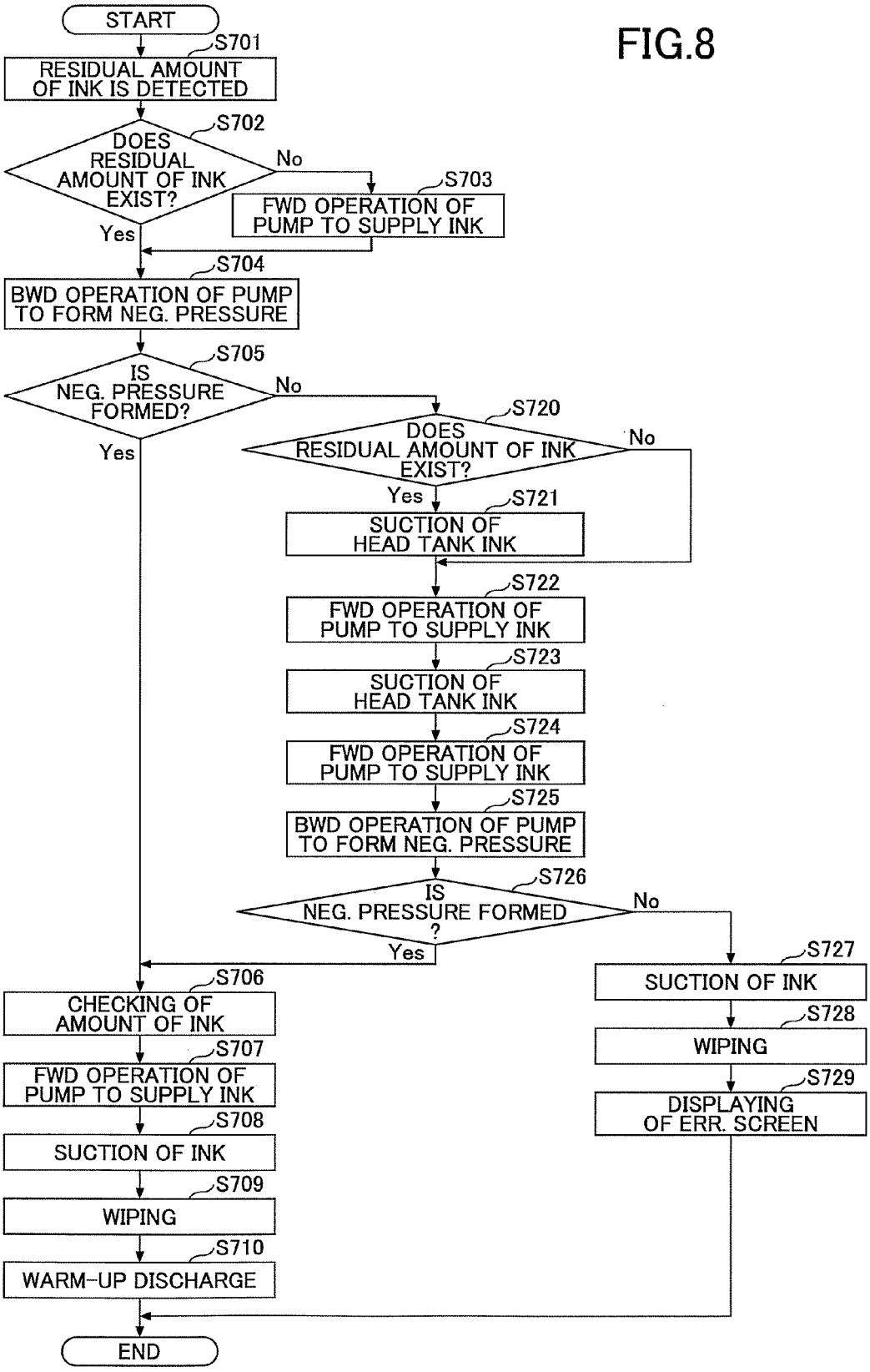
FIG. 8 is a flowchart for explaining a control process performed by an image forming device of a first embodiment of the present disclosure to carry out an air-open ink filling procedure.

FIG. 8 is a flowchart for explaining a control process performed by the main controller of the image forming device of the first embodiment to carry out the air-open ink filling procedure.

As illustrated in FIG. 8, if a start of the air-open ink filling procedure is detected, the main controller 301 detects the residual amount of ink in the head tank 35 (S701). The main controller 301 determines whether an adequate amount of ink in the head tank 35 exists (S702).

When it is determined at step S702 that an adequate amount of ink in the head tank 35 does not exist, the main controller 301 causes the tube pump motor driver circuit 311 to perform the forward operation of the tube pump 100 (or forward rotation of the pressing roller 104) to supply ink from the ink cartridge 10 to the head tank 35 via the tube 37 (S703). To form negative pressure in the head tank 35, it is necessary to suck ink from the head tank 35. Hence, it is necessary that at least the amount of ink to be sucked at the time of negative pressure formation is contained in the head tank 35. The step S703 is performed in order to supplement the head tank 35 with the amount of ink to be sucked at the time of negative pressure formation. Therefore, the determination of the step S702 is performed by determining whether the residual amount of ink in the head tank 35 is larger than the amount of ink to be sucked at the time of negative pressure formation. In this case, the amount of ink to be sucked at the time of negative pressure formation is predetermined and stored beforehand in the ROM 321, for example. Accordingly, when performing the step S702, the main controller 301 reads the stored amount of ink from the ROM 321.

Subsequently, the main controller 301 causes the tube pump motor driver circuit 311 to perform the backward operation of the tube pump 100 by a given amount (or backward rotation of the pressing roller 104) to suck ink from the head tank 35 into the ink cartridge 10 (S704). Namely, negative pressure in the head tank 35 is formed at the step S704. The given amount of the backward operation at the step S704 may be specified by time (for example, 4 seconds). Alternatively, it may be specified by an amount of movement (for example, the number of revolutions of the pressing roller 104 or the amount of displacement of the pressing position of the pressing roller 104). For example, the given amount of the backward operation at the step S704 may be stored beforehand in the ROM 321.

After the backward operation of the tube pump 100 by the given amount, the main controller 301 determines whether the negative pressure formation is performed successfully (S705). For example, if the amount of ink in the head tank 35 is decreased by the amount that is proportional to the given amount of the backward operation (or the amount needed for the negative pressure formation), it is determined at the step S705 that the negative pressure formation is performed successfully. If the amount of ink in the head tank 35 is not decreased by the amount, it is determined at the step S705 that the negative pressure formation is not performed successfully (failure). A typical method of measuring the amount of ink in the head tank 35 is to optically read a position of the filler 36, attached to the film 38 of the head tank 35, by using a photo sensor. This method of measuring the amount of ink in the head tank 35 may also be used at the step S701.

When it is determined at the step S705 that the negative pressure formation is performed successfully, the main controller 301 checks the amount of ink in the head tank 35 at the time of negative pressure formation (S706).

Subsequently, the main controller 301 carries out the forward rotation of the pressing roller 104 of the tube pump 100 so that ink from the ink cartridge 10 is supplied to the head tank 35 (S707).

Subsequently, with the carriage 33 being placed at the location of the maintenance recovery device 91, the main controller 301 causes the maintenance/recovery device motor driver circuit 308 to drive the maintenance recovery device 91 to perform the recovery operation of the recording head 34 to suck ink from the nozzles of the recording head (S708), the wiping operation for wiping the respective faces of the nozzles of the recording head 34 with the wiper blade 93 (S709), and the warm-up discharging operation (S710).

On the other hand, when it is determined at the step S705 that the negative pressure formation has failed, the main controller 301 performs processing in order to cancel the sticking of the ink-supply tube 37. One of the causes of the failure of the negative pressure formation is a possibility that the ink-supply tube 37 is crushed in the cross-section thereof at the position where the tube 37 is pressed by the pressing roller 104 and the tube 37 is stuck to the tub supporting wall 102.

Figure 9B:
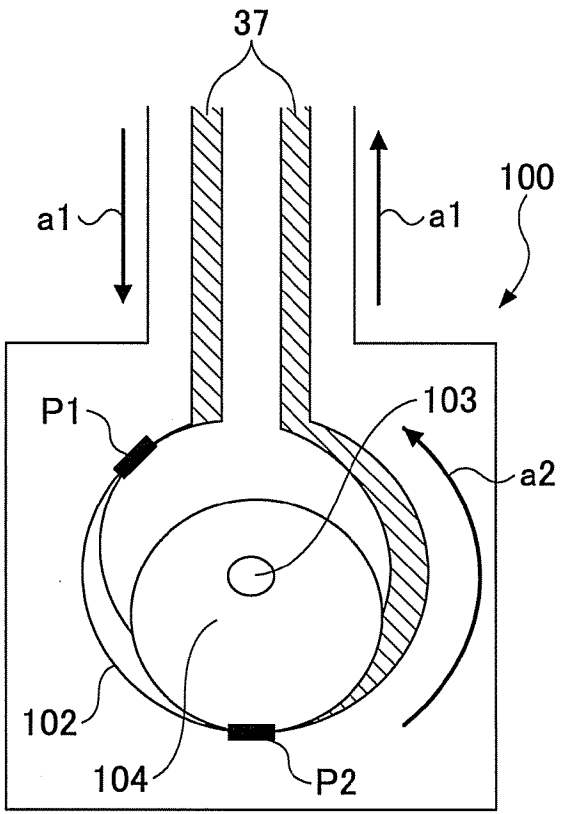
FIG. 9A and FIG. 9B are diagrams for explaining the sticking of an ink-supply tube.
Figure 9A:
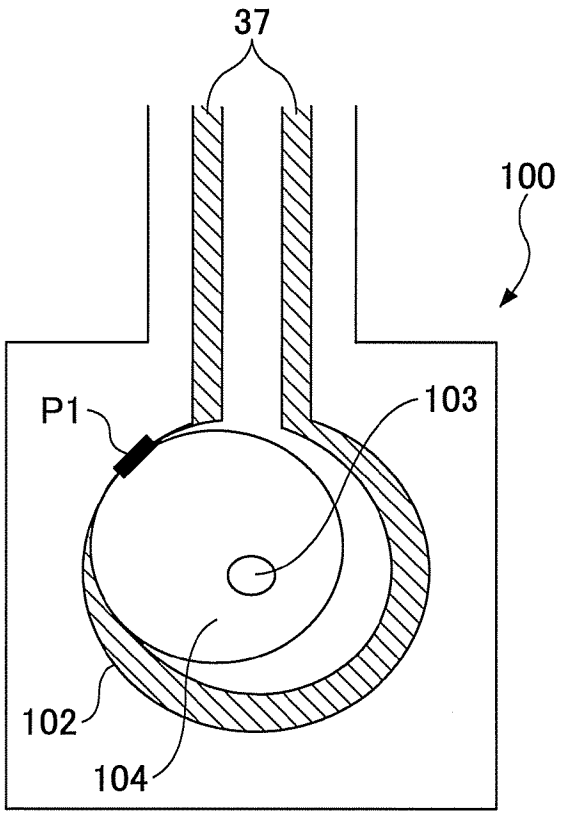

FIG. 9A and FIG. 9B are diagrams for explaining the sticking of the ink-supply tube 37. FIG. 9A illustrates the state of the tube pump 100 when the step S704 is performed. As illustrated in FIG. 9A, the ink-supply tube 37 is pressed by the pressing roller 104 at the position P1 and the tube pump 100 stops operation. In other words, the ink-supply tube 37 is crushed in the cross-section thereof at the position P1 where the tube 37 is pressed by the pressing roller 104.

FIG. 9B illustrates the state of the tube pump 100 when the negative pressure formation is started and the backward rotation of the pressing roller 104 in the direction indicated by the arrow a2 in FIG. 9B is started (or the backward operation of the tube pump). As illustrated in FIG. 9B, the position where the tube 37 is pressed by the pressing roller 104 is moved to the position 22 but the tube 37 is still crushed in the cross-section thereof at the position P1. In this state, almost no ink exists in the region of the tube 37 between the position P1 and the position P2. This is because the tube 37 is crushed at the position P1 and so ink is not sucked from the head tank 35.

Normally, the backward rotation of the pressing roller 104 is continued further from the state of FIG. 9B. However, there is a high possibility that, even if the backward rotation of the pressing roller 104 is continuously performed (for example, by one or more revolutions), the sticking of the ink-supply tube 37 at the position P1 is not canceled, which will be described later. The arrows a1 in FIG. 9B indicate the intended direction of feeding ink which is desirable for the cancellation of the sticking of the tube 37.

In order to cancel the state of the tube pump 100 as illustrated in FIG. 9B, the main controller 301 performs the next step S720 and subsequent steps.

First, the main controller 301 determines whether the residual amount of ink in the head tank 35 which exceeds the required amount of ink for printing exists (S720). Specifically, the position of the filler 36 actually detected by the photo sensor is compared with a predetermined reference position of the filler 36 at which the required amount of ink for printing is contained in the head tank 35, which position is stored beforehand in the EEPROM 315.

When it is determined at the step S720 that the residual amount of ink in the head tank 35 as described above exists, the main controller 301 causes the maintenance/recovery device motor driver circuit 308 to drive the maintenance recovery device 91 to suck ink from the head tank 35 (S721). At this time, the adequate amount of ink in the head tank 35 exists, and if ink is further supplied to the head tank 35 by the subsequently performed forward rotation of the pressing roller 104, such operation causes the ink in the head tank 35 to overflow. To avoid this, the step S721 is performed.

On the other hand, when it is determined at the step S720 that the residual amount of ink in the head tank 35 as described above does not exist, the step S721 is not performed.

Subsequently, the main controller 301 carries out the forward rotation of the pressing roller 104 (S722). By this operation, the pressing roller 104 is rotated in the forward direction to supply ink from the ink cartridge 10, which enables the supplied ink to pass through the portion of the tube 37 where the sticking of the tube 37 takes place, and so the sticking of the tube 37 is canceled by the fluid pressure of the supplied ink.

Figure 10A:
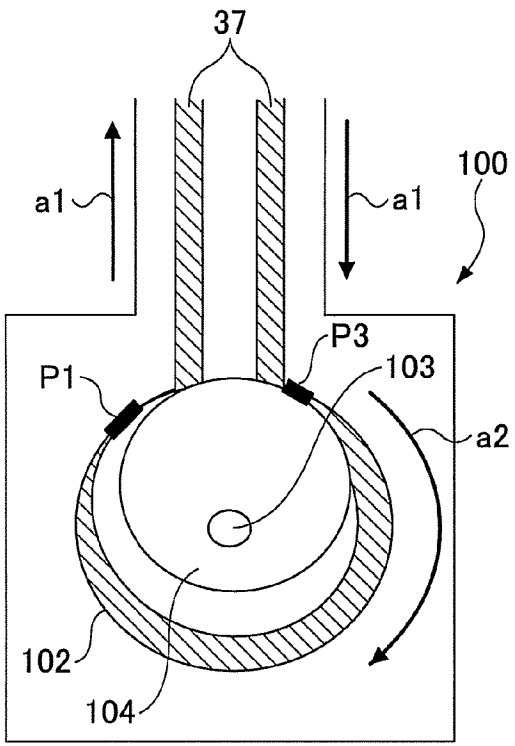
FIG. 10A, FIG. 10B and FIG. 10C are diagrams for explaining the cancellation of the sticking of the ink-supply tube by normal rotation of a tube pump.
Figure 10B:
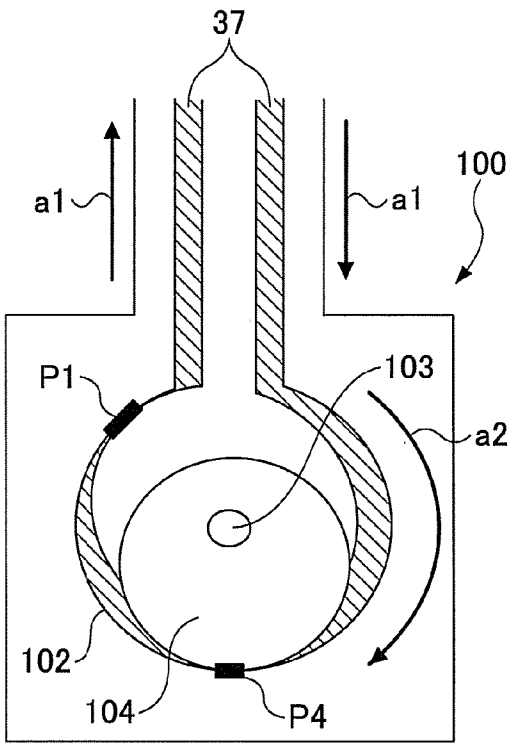
Figure 10C:
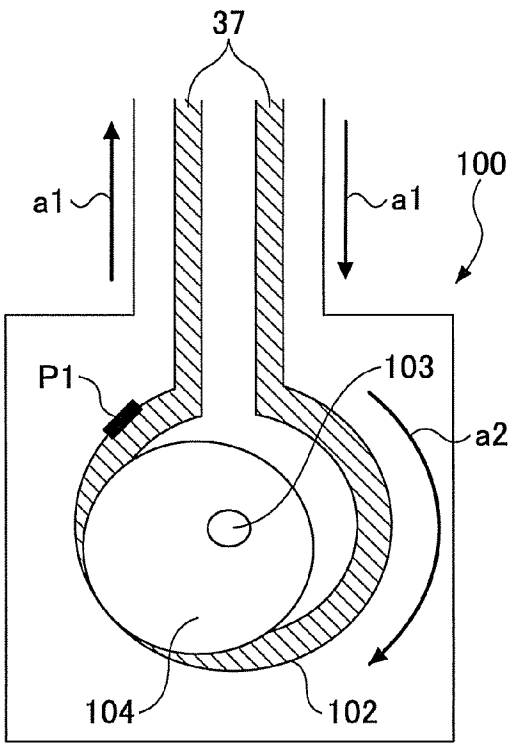

FIG. 10A, FIG. 10B and FIG. 10C are diagrams for explaining the cancellation of the sticking of the ink-supply tube by the forward operation of the tube pump.

For example, if the forward rotation of the pressing roller 104 is started from the state of FIG. 9B, the pressing position of the pressing roller 104 is moved to pass through the position P1. As a result, the pressing roller 104 is in the state as illustrated in FIG. 10A.

As illustrated in FIG. 10A, the ink-supply tube 37 is pressed by the pressing roller 104 at the position P3. Hence, the residual ink in the region of the tube from the position P3 to the position P1 will contribute to the cancellation of the sticking of the ink-supply tube 37. Namely, if the pressing roller 104 is continuously rotated in the forward direction from the state of FIG. 10A, the pressing roller 104 is in the state as illustrated in FIG. 10B.

As illustrated in FIG. 10B, the pressing position of the pressing roller 104 is moved from the position P3 to the position P4. The amount of ink contained in the region of the tube from the position P4 to the position P1 as illustrated in FIG. 10B is almost the same as the amount of the residual ink in the region of the tube from the position P3 to the position P1 as illustrated in FIG. 10A. Hence, the fluid pressure of the ink contained in the region of the tube from the position P4 to the position P1 in the state of FIG. 10B is increased according to the forward rotation of the pressing roller 104.

As the fluid pressure of the ink is subsequently increased to a pressure that allows the cancellation of the sticking of the ink-supply tube 37, the sticking of the ink-supply tube 37 at the position P1 will be canceled as illustrated in FIG. 10C. Therefore, in order to cancel the sticking of the ink-supply tube 37, it is necessary to rotate the pressing roller 104 in the forward direction by one or more revolution from the starting position of the forward rotation of the pressing roller 104. For example, the necessary number of revolutions for the forward rotation of the pressing roller 104 at the step S722 may be stored beforehand in the ROM 321.

The instantaneous states of the tube pump 100 at a certain time instant in the process of the forward rotation of the pressing roller 104 are illustrated in FIG. 10A, FIG. 10B, and FIG. 10C respectively, and these figures do not illustrate the stop position of the pressing roller 104 in each of the respective states.

Subsequently, in order to remove the ink supplied to the head tank 35 by the forward rotation of the pressing roller 104 at the step S722, the main controller 301 controls the maintenance recovery device 91 to suck ink from the head tank 35 (S723).

Subsequently, the main controller 301 carries out the forward rotation of the pressing roller 104 to supply the amount of ink required for negative pressure formation to the head tank 35 (S724).

Alternatively, if the amount of ink required for negative pressure formation is already contained in the head tank 35 at the end of the step S723, the step S724 may not be performed. Alternatively, if the residual amount of ink in the head tank 35 at the end of the step S722 is smaller than the amount of ink required for negative pressure formation, the step S723 may not be performed.

In the present embodiment illustrated in FIG. 8, in order to make such a complicated control unnecessary, the steps S723 and S724 are performed normally.

Subsequently, the main controller 301 carries out the backward rotation of the pressing roller 104 to suck ink from the head tank 35 into the ink cartridge 10 (S725). Subsequently, the main controller 301 determines whether the negative pressure formation is performed successfully (S726). The steps S725 and S726 are essentially the same as the previously described steps S704 and S705.

When it is determined at the step S726 that the negative pressure formation is performed successfully, the above-described steps S706-S710 are performed. On the other hand, when it is determined at the step S726 that the negative pressure formation has failed, the main controller 301 controls the maintenance recovery device 91 to perform the recovery operation of the recording head 34 to suck ink from the nozzles of the recording head 34 (S727), and perform the wiping operation for wiping of the respective faces of the nozzles of the recording head 34 (S728).

Subsequently, the main controller 301 transmits an error signal through the communication circuit 300 to an external device (for example, a personal computer) from which a printing request has been received via the network, so that an error screen is displayed on the external device (S729).

Figure 11:
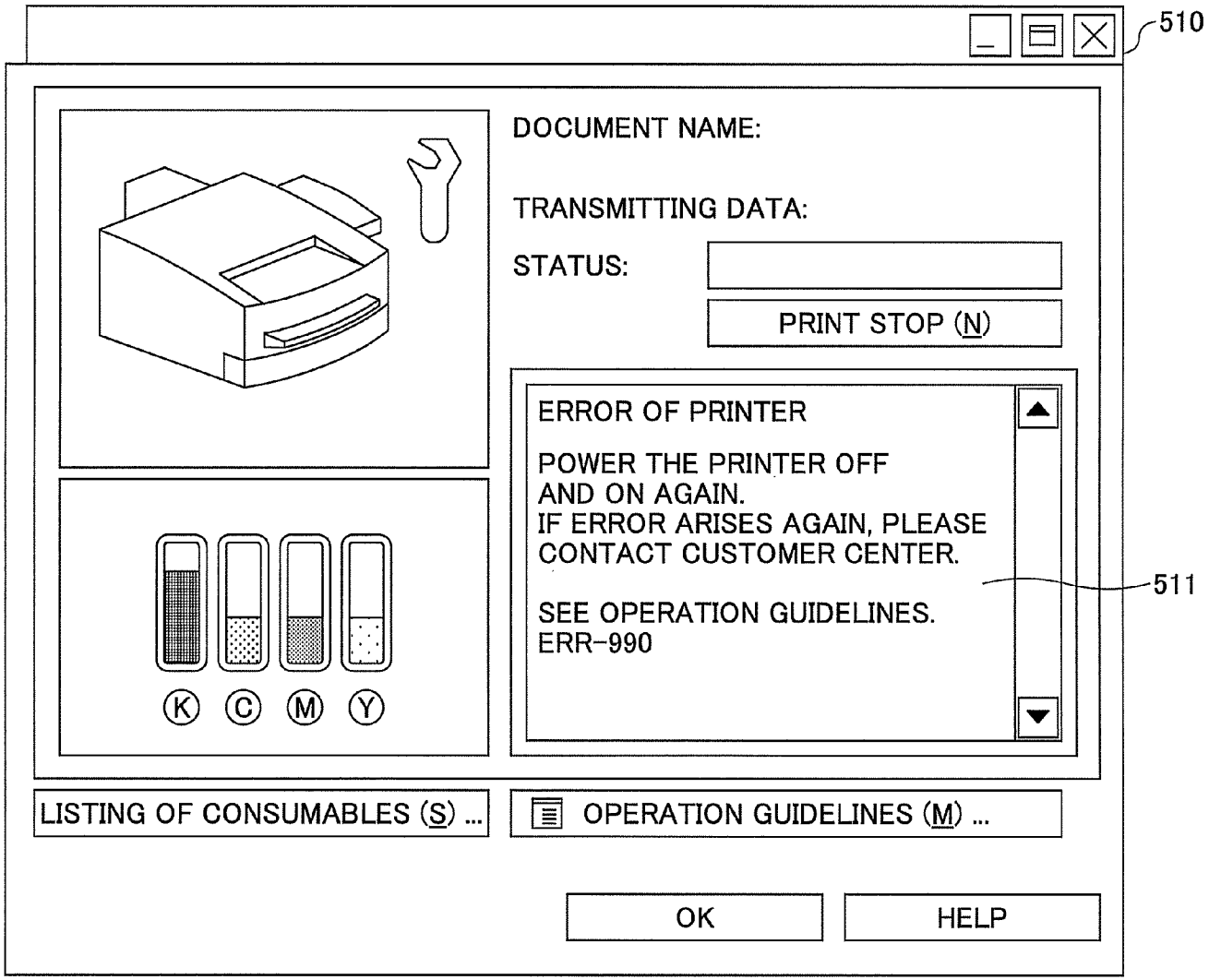
FIG. 11 is a diagram illustrating an example of an error screen which is displayed.

FIG. 11 is a diagram illustrating an example of an error screen 510 which is displayed on an external device. As illustrated in FIG. 11, the error screen 510 contains an error message 511 being displayed. The error message 511 contains information which notifies a user on the external device that the image forming device 1 should be powered off and on again, and the customer center should be contacted if an error arises again.

As described in the foregoing, according to the image forming device 1 of the first embodiment, even if the ink-supply tube 37 is stuck to the tube supporting wall 102 to block off the flow of ink, the sticking of the tube can be appropriately canceled by carrying out the forward rotation of the pressing roller 104. As a result, the normal operation of the image forming device 1 can be maintained and the number of service calls to the customer center or the like can be reduced.

Alternatively, the error screen 510 as illustrated in FIG. 11 may be displayed on the displaying part of the operation panel 7 of the image forming device 1.

Next, a control process performed by an image forming device of a second embodiment of the present disclosure to carry out the air-open ink filling procedure will be described. Unless otherwise specified, the image forming device 1 of the second embodiment is essentially the same as that of the first embodiment and a description thereof will be omitted.

Figure 12:
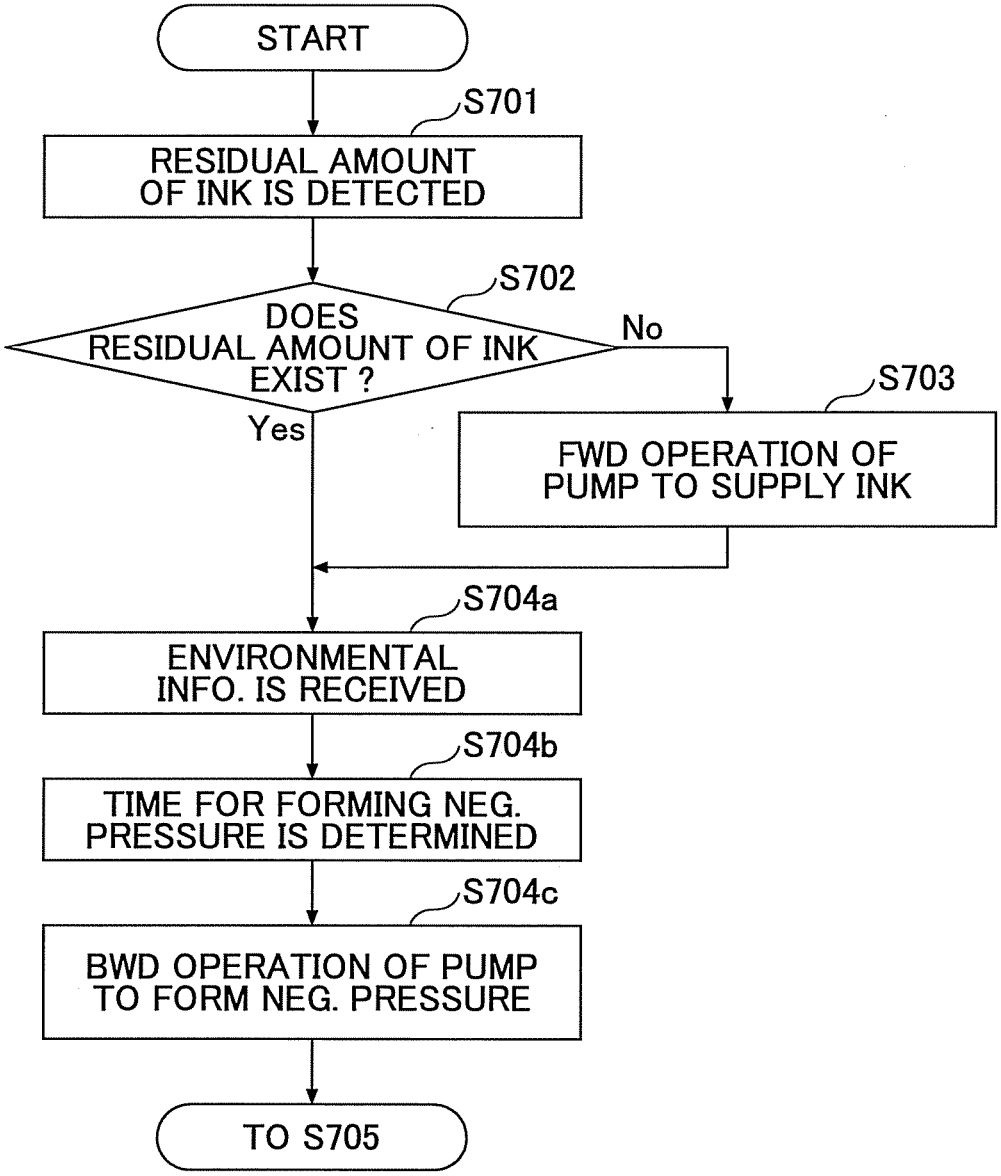
FIG. 12 is a flowchart for explaining a control process performed by an image forming device of a second embodiment of the present disclosure to carry out the air-open ink filling procedure.

FIG. 12 is a flowchart for explaining the control process performed by the image forming device of the second embodiment to carry out the air-open ink filling procedure. In FIG. 12, steps which are the same as corresponding steps in FIG. 8 are designated by the same reference numerals and a description thereof will be omitted. In the following, a description will be given of the points of the control process of the second embodiment which are different from the control process of the first embodiment.

In the control process of FIG. 12, the processing of the step S704 in the control process of FIG. 8 is divided into three steps S704*a* to S704*c*.

As illustrated in FIG. 12, in step S704*a*, the main controller 301 receives environmental information of the arrangement location of the image forming device 1. This environmental information may include a temperature, a humidity, etc. of the outside or the inside of the image forming device 1. A temperature and a humidity included in the environmental information may be detected by a temperature sensor, a humidity sensor, etc. which are disposed in the image forming device 1. The temperature sensor, the humidity sensor, etc. constitute a part of the sensor detecting circuit 316 as illustrated in FIG. 7.

Subsequently, the main controller 301 determines an amount of backward operation by which the backward rotation of the pressing roller 104 is performed for negative pressure formation, based on the received environmental information and a table of backward-operation amounts (S704*b*).

FIG. 13 is a diagram illustrating an example of a table of backward-operation amounts.

In the table 520 of backward-operation amounts of FIG. 13, several backward-operation amounts are registered in association with respective combinations of temperature and humidity. Therefore, in step S704*b*, the main controller 301 determines an amount of backward operation by accessing the backward-operation amount table 520 in accordance with the combination of temperature and humidity in the received environmental information.

In the previously described embodiment, the amount of backward operation is constant and equal to a fixed value. In contrast, in the second embodiment, the amount of backward operation is dynamically determined in accordance with the contents of the environmental information. For example, the backward-operation amount table 520 is stored in the ROM 321. In the example illustrated in FIG. 13, a time duration for which the backward operation of the pump is continuously performed is stored as the amount of backward operation. Alternatively, the amount of backward operation may be specified by the amount of movement of the pressing roller 104.

The reason the amount of backward operation is determined according to the environmental information will be described. The likelihood of the sticking of the ink-supply tube 37 in the tube pump 100 greatly varies depending on the environmental condition in which the image forming device 1 is installed. For example, when the image forming device 1 is installed in a low-temperature, low-humidity environment, the viscosity of ink in the tube pump 100 increases, and the sticking of the ink-supply tube 37 is likely to take place. On the other hand, when the image forming device 1 is installed in a high-temperature, high-humidity environment, the viscosity of ink in the tube pump 100 does not increase very much, and the sticking of the ink-supply tube 37 does not easily take place.

It is preferred that the amount of backward operation is set to the smallest possible value. This is because if the amount of backward operation is set to a smaller value, the amount of wear of the ink-supply tube 37 can be reduced. In addition, if the amount of backward operation is set to a smaller value, the time for performing the processing in response to a printing request can be shortened.

In the present embodiment, the amount of backward operation is dynamically determined based on the received environmental information and the backward operation amount table 520. Thereby, it is possible to prevent the amount of backward operation from being unnecessarily large when the sticking of the ink-supply tube 37 does not easily take place. When the sticking of the ink-supply tube 37 easily takes place, the amount of backward operation can be set to a relatively large value, which will ensure the cancellation of the sticking of the ink-supply tube 37 during backward operation of the tube pump.

In the present embodiment, both the temperature and the humidity in the environmental information are used. Alternatively, either the temperature or the humidity may be used as the environmental information.

Subsequently, the main controller 301 carries out the backward operation of the tube pump 100 by the determined amount to suck ink from the head tank 35 into the ink cartridge 10 (S704*c*). As a result, negative pressure is formed in the head tank 35.

Step S705 and subsequent steps of the control process of the second embodiment are the same as corresponding steps of the control process illustrated in FIG. 8, and the illustration thereof in FIG. 12 will be omitted.

As described in the foregoing, according to the image forming device of the second embodiment, the amount of backward operation is dynamically determined according to the environmental condition of the image forming device 1, and thereby the time for performing processing in response to a printing request can be shortened and the amount of wear of the ink-supply tube can be reduced.

Next, a control process performed by an image forming device of a third embodiment of the present disclosure to carry out the air-open ink filling procedure will be described. Unless otherwise specified, the image forming device 1 of the third embodiment is essentially the same as that of the first embodiment and a description thereof will be omitted.

The sticking of the ink-supply tube 37 does not always cause the negative pressure formation to fail. The cancellation of the tube sticking may fail only when the position where the sticking of the ink-supply tube 37 takes place is within a predetermined range. In other words, if the position where the sticking of the ink-supply tube 37 takes place is outside the predetermined range, the sticking of the ink-supply tube 37 is canceled in the process of the backward rotation of the pressing roller 104.

Figure 14:
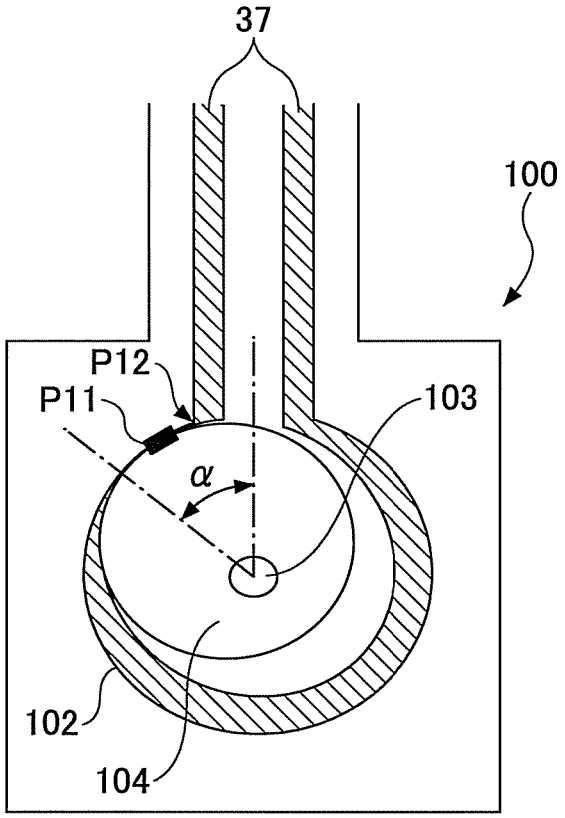
FIG. 14 is a diagram for explaining the state in which the sticking of an ink-supply tube may not be canceled only by the backward operation of a tube pump.

FIG. 14 is a diagram for explaining the state in which the sticking of an ink-supply tube may not be canceled only by the backward operation of a tube pump.

For example, when the sticking of an ink-supply tube 37 takes place at position P11, it is difficult to cancel the sticking of the tube only by the backward rotation of the pressing roller 104 because the distance from position P11 to position P12 is not large enough to cancel the sticking of the tube. In this case, the distance between position P11 and position P12 is too small, and the amount of ink needed to generate a fluid pressure that can eliminate the tube sticking between position P11 and position P12 cannot be supplied though the one-revolution backward rotation of the pressing roller 104.

Accordingly, when a stop position of the pressing part of the pressing roller 104 is within a predetermined range $\alpha$ of the tube supporting wall 102 and the sticking of the ink-supply tube 37 takes place at that position, it is necessary to carry out the forward rotation of the pressing roller 104 (step S722). As illustrated in FIG. 14, the range $\alpha$ is measured from an end (near the position P12) of the curved surface of the tube supporting wall 102 pressed by the pressing part of the pressing roller 104 on the side of the head tank 35.

On the other hand, when the sticking of the ink-supply tube 37 takes place at a position outside the range $\alpha$, it is possible to cancel the tube sticking by performing the backward rotation of the pressing roller 104 at the time of negative pressure formation. In this case, the distance between the position 212 and the position of the tube sticking is large enough to supply the amount of ink for generating the fluid pressure that can eliminate the tube sticking. Some margins in both the forward and backward directions may be added to the range $\alpha$. Therefore, the range $\alpha$ may be a range containing the end of the portion of the tube supporting face 102 pressed by the pressing part of the pressing roller 104 on the side of the head tank 35.

Figure 15:
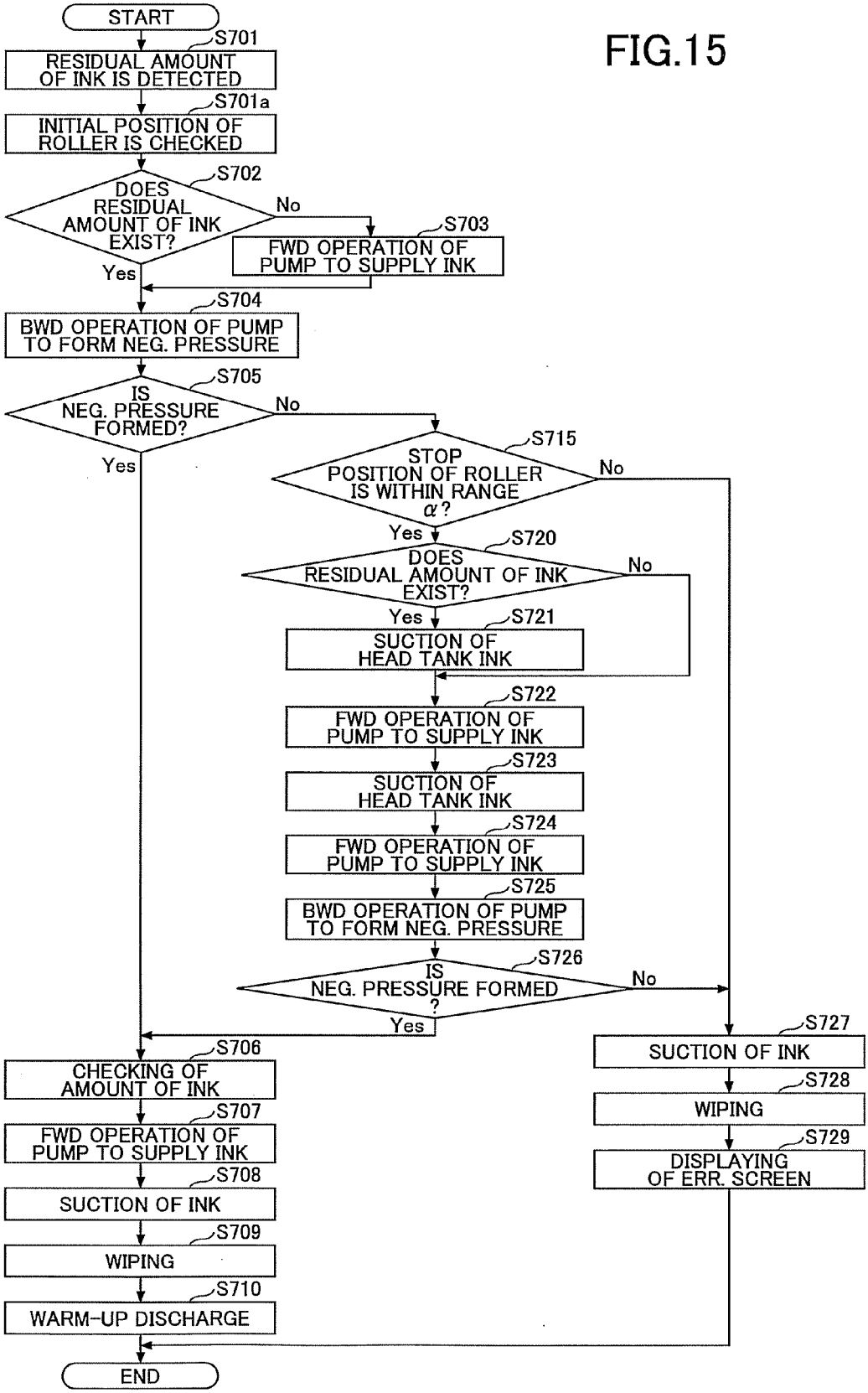
FIG. 15 is a flowchart for explaining a control process performed by an image forming device of a third embodiment of the present disclosure to carry out the air-open ink filling procedure.

FIG. 15 is a flowchart for explaining a control process performed by the image forming device of the third embodiment to carry out the air-open ink filling procedure. In FIG. 15, steps which are the same as corresponding steps in FIG. 8 are designated by the same reference numerals and a description thereof will be omitted.

As illustrated in FIG. 15, after the step S701 is performed, the main controller 301 checks an initial stop position of the pressing part of the pressing roller 104 of the tube pump 100 (S701*a*). For example, the position of the pressing roller 104 may be checked by optically reading an encoder sheet attached to the shaft 103 of the tube pump 100 by using a photo sensor.

Subsequently, when it is determined at the step S705 that the negative pressure formation has failed, the main controller 301 determines whether the stop position of the pressing roller 104 is within the range α (see FIG. 14) (S715).

When it is determined at the step S715 that the stop position of the pressing roller 104 is within the range α, the main controller 301 performs the step S720 and the subsequent steps as in the first embodiment. Namely, as previously described, the sticking of the ink-supply tube 37 is canceled by performing the forward rotation of the pressing roller 104. For example, the value which indicates the range α may be computed based on the theoretical value or the experimental value, and the computed value may be stored beforehand in the ROM 321.

On the other hand, when it is determined at the step S715 that the stop position of the pressing roller 104 is outside the range α, there is a high possibility that the cause of the failure of the negative pressure formation is not the sticking of the ink-supply tube 37. As described above, when the stop position of the pressing roller 104 is outside the range α, the sticking of the ink-supply tube 37 may be canceled by the backward rotation of the pressing roller 104 in the process of negative pressure formation. Therefore, the main controller 301 performs the step S727 and the subsequent steps, without performing the forward rotation of the pressing roller 104. For example, another cause of the failure of the negative pressure formation, different from the sticking of the ink-supply tube 37, may be the presence of cracks in the ink-supply tube 37 which allows ink to leak out of the cracked tube parts.

As described in the foregoing, according to the image forming device of the third embodiment, if the negative pressure formation has failed and the cause of the failure is the sticking of the ink-supply tube 37 with a high possibility, then the forward rotation of the pressing roller 104 is carried out. Therefore, it is possible to reduce the amount of wear of the ink-supply tube 37 in an appropriate manner.

Next, an image forming device of a fourth embodiment of the present disclosure will be described. Unless otherwise specified, the image forming device 1 of the fourth embodiment is essentially the same as that of the first embodiment and a description thereof will be omitted.

As previously explained in the third embodiment, the situation in which the sticking of the ink-supply tube 37 is not canceled even when the backward rotation of the pressing roller 104 is performed at the time of negative pressure formation occurs only when the position where the sticking of the ink-supply tube 37 takes place is within the predetermined range α. For this reason, the image forming device of the fourth embodiment is arranged so that the pressing roller 104 is controlled to make the stop position of the pressing part of the pressing roller 104 outside the predetermined range α.

Figure 16:
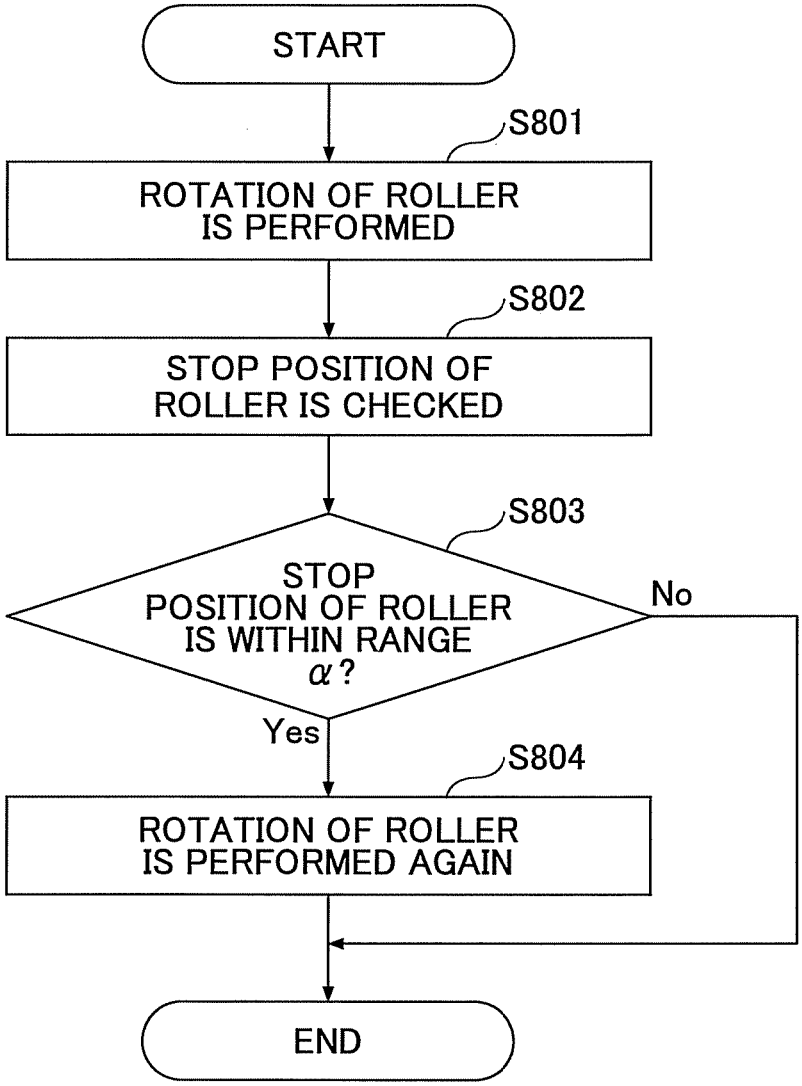
FIG. 16 is a flowchart for explaining a control process performed by an image forming device of a fourth embodiment of the present disclosure to carry out a pressing roller controlling procedure.

FIG. 16 is a flowchart for explaining a control process performed by the image forming device of the fourth embodiment to carry out a pressing roller controlling procedure.

As illustrated in FIG. 16, the control process is performed whenever the pressing roller 104 is rotated, regardless of whether the forward rotation or the backward operation of the pressing roller 104 is carried out.

The main controller 301 detects that the rotation of the pressing roller 104 is performed (S801). The main controller 301 checks a stop position (or the position of the pressing part) of the pressing roller 104 (S802). The method of checking the position of the pressing roller 104 is the same as described above.

Subsequently, the main controller 301 determines whether the stop position of the pressing roller 104 is within the range α (S803).

When it is determined at the step S803 that the stop position of the pressing roller 104 is within the range α, the main controller 301 carries out the rotation of the pressing roller 104 again to shifts the position of the pressing roller 104 to a position exceeding the range α (S804). The direction of the additional rotation of the pressing roller 104 performed at the step S804 may be the same as the direction of the rotation performed at the step S801.

On the other hand, when it is determined at the step S803 that the stop position of the pressing roller 104 is not within the range α, the main controller 301 does not perform the additional rotation of the pressing roller 104 as performed at the step S804.

As described in the foregoing, according to the image forming device of the fourth embodiment, it is possible to avoid the situation in which the stop position of the pressing roller 104 is within the range where the sticking of the ink-supply tube 37 is not canceled only by the backward rotation of the pressing roller 104. Hence, the frequency of failures of the cancellation of the tube sticking can be reduced.

According to the present disclosure, it is possible to appropriately prevent the sticking of a tube in a tube pump which supplies a recording fluid to a recording head.

The present disclosure is not limited to the above-described embodiments, and variations and modifications may be made without departing from the scope of the present disclosure.

The present application is based on Japanese patent application No. 2009-286787, filed on Dec. 17, 2009, the contents of which are incorporated herein by reference in their entirety.

What is claimed is:

1. An image forming device comprising:

a pump which supplies a recording fluid, contained in a first container, to a second container via a tube; and a control unit configured to perform rotation of a roller, disposed in the pump, to press the tube and feed the recording fluid in the tube, wherein, when a negative pressure in the second container is not formed by performing a first backward rotation of the roller by a predetermined amount, the control unit performs a forward rotation of the roller and performs a second backward rotation of the roller after an end of the forward rotation.

2. The image forming device according to claim 1, further comprising:

a detection unit which detects at least one of a temperature and a humidity of the image forming device; and a memory unit which stores a table of amounts of backward rotation of the roller which are registered in association with at least one of temperatures and humidities of the image forming device, wherein the control unit is configured to determine a backward rotation amount as the predetermined amount of the first backward rotation, based on the at least one of the temperature and the humidity detected by the detection unit and the table stored in the memory unit, so that, when a negative pressure in the second container is not formed by performing the first backward rotation of the roller by the determined amount, the control unit performs the forward rotation of the roller and performs the second backward rotation of the roller.

3. The image forming device according to claim 1, wherein the control unit is configured to detect an initial stop position of the roller before the first backward rotation of the roller is performed, so that, when a negative pressure in the second container is not formed by performing the first backward rotation of the roller by the predetermined amount and the stop position of the roller is within a predetermined range, the control unit performs the forward rotation of the roller and performs the second backward rotation of the roller.

4. The image forming device according to claim 1, wherein the control unit is configured to control a stop position of the roller, so that the stop position of the roller is located outside a predetermined range.

5. The image forming device according to claim 1, wherein the control unit determines that the negative pressure is formed if the recording fluid stored in the second container is reduced by an amount corresponding to the predetermined amount of the first backward rotation of the roller.

6. A pump control method for use in an image forming device including a pump which supplies a recording fluid contained in a first container to a second container via a tube, comprising:

performing, by a control unit of the image forming device, rotation of a roller disposed in the pump to press the tube and feed the recording fluid in the tube, wherein, when a negative pressure in the second container is not formed by performing a first backward rotation of the roller by a predetermined amount, a forward rotation of the roller is performed and a second backward rotation of the roller is performed after an end of the forward rotation.

7. The method according to claim 6, further comprising:

detecting, by a detection unit of the image forming device, at least one of a temperature and a humidity of the image forming device;

storing, by a memory unit of the image forming device, a table of amounts of backward rotation of the roller which are registered in association with at least one of temperatures and humidities of the image forming device; and determining, by the control unit, a backward rotation amount as the predetermined amount of the first backward rotation, based on the at least one of the temperature and the humidity detected by the detection unit and the table stored in the memory unit, wherein, when a negative pressure in the second container is not formed by performing the first backward rotation of the roller by the determined amount, the forward rotation of the roller is performed and the second backward rotation of the roller is performed.

8. The method according to claim 6, further comprising:

detecting, by the control unit, an initial stop position of the roller before the first backward rotation of the roller is performed, wherein, when a negative pressure in the second container is not formed by performing the first backward rotation of the roller by the predetermined amount and the stop position of the roller is within a predetermined range, the forward rotation of the roller is performed and the second backward rotation of the roller is performed.

9. The method according to claim 6, wherein the performing of the rotation of the roller is configured to control a stop position of the roller, so that the stop position of the roller is located outside a predetermined range.

10. A computer-readable recording medium storing a program which, when executed by a computer, causes the computer to perform a pump control method for use in an image forming device including a pump which supplies a recording fluid contained in a first container to a second container via a tube, the method comprising:

performing, by a control unit of the image forming device, rotation of a roller disposed in the pump to press the tube and feed the recording fluid in the tube, wherein, when a negative pressure in the second container is not formed by performing a first backward rotation of the roller by a predetermined amount, a forward rotation of the roller is performed and a second backward rotation of the roller is performed after an end of the forward rotation.

11. The recording medium according to claim 10, wherein the method further comprises:

detecting, by a detection unit of the image forming device, at least one of a temperature and a humidity of the image forming device;

storing, by a memory unit of the image forming device, a table of amounts of backward rotation of the roller which are registered in association with at least one of temperatures and humidities of the image forming device; and determining, by the control unit, a backward rotation amount as the predetermined amount of the first backward rotation, based on the at least one of the temperature and the humidity detected by the detection unit and the table stored in the memory unit, wherein, when a negative pressure in the second container is not formed by performing the first backward rotation of the roller by the determined amount, the forward rotation of the roller is performed and the second backward rotation of the roller is performed.

12. The recording medium according to claim 10, wherein the method further comprises:

detecting, by the control unit, an initial stop position of the roller before the first backward rotation of the roller is performed, wherein, when a negative pressure in the second container is not formed by performing the first backward rotation of the roller by the predetermined amount and the stop position of the roller is within a predetermined range, the forward rotation of the roller is performed and the second backward rotation of the roller is performed.

13. The recording medium according to claim 10, wherein the performing of the rotation of the roller is configured to control a stop position of the roller, so that the stop position of the roller is located outside a predetermined range.

* * * * *